US009814282B2

(12) United States Patent
Merrick

(10) Patent No.: US 9,814,282 B2
(45) Date of Patent: Nov. 14, 2017

(54) HARSH ENVIRONMENT BUCKLE ASSEMBLIES AND ASSOCIATED SYSTEMS AND METHODS

(71) Applicant: Shield Restraint Systems, Inc., Elkhart, IN (US)

(72) Inventor: David D Merrick, Rochester, IN (US)

(73) Assignee: Shield Restraint Systems, Inc., Elkhart, IN (US)

( * ) Notice: Subject to any disclaimer, the term of this patent is extended or adjusted under 35 U.S.C. 154(b) by 0 days.

(21) Appl. No.: 15/013,883

(22) Filed: Feb. 2, 2016

(65) Prior Publication Data

US 2017/0215526 A1 Aug. 3, 2017

(51) Int. Cl.
*A44B 11/25* (2006.01)

(52) U.S. Cl.
CPC ..... *A44B 11/2523* (2013.01); *A44B 11/2561* (2013.01)

(58) Field of Classification Search
CPC ..... A44B 11/2523; A44B 11/2563; A44B 11/2546; A44B 11/2561; Y10T 24/45623; Y10T 24/45628
See application file for complete search history.

(56) References Cited

U.S. PATENT DOCUMENTS

| | | | |
|---|---|---|---|
| 906,045 | A | 12/1908 | Martin |
| 1,079,080 | A | 11/1913 | Ward |
| 1,369,456 | A | 2/1921 | Meredith |
| 1,438,898 | A | 12/1922 | Carpmill |
| 1,816,262 | A | 7/1931 | Ritter |
| 1,930,378 | A | 10/1933 | Beagan |
| 2,132,556 | A | 10/1938 | Blackshaw |
| 2,255,258 | A | 9/1941 | Lethern et al. |
| 2,372,557 | A | 3/1945 | Dowd |

(Continued)

FOREIGN PATENT DOCUMENTS

| | | | |
|---|---|---|---|
| CA | 2036493 | A1 | 8/1991 |
| CA | 2038505 | A1 | 9/1991 |

(Continued)

OTHER PUBLICATIONS

Britax, "COMPAQ: Convertible Car Seats," Buckle Image, accessed Oct. 12, 2010, www.britax.com.au/car-seats/compaq, 2 pages.

(Continued)

*Primary Examiner* — Robert Sandy
*Assistant Examiner* — David M Upchurch
(74) *Attorney, Agent, or Firm* — Perkins Coie LLP

(57) ABSTRACT

In one embodiment, a buckle assembly includes a release actuator that can apply a first force and a second force to release a web connector. The release actuator is slidably coupled to a frame that includes a pair of opposing openings. A pawl is pivotally mounted to the frame via the opposing openings and includes a latch portion positioned to releasably engage the web connector. A biasing member is operably positioned between the release actuator and the pawl, and the release actuator is movable to compress the biasing member and exert the first force against the pawl. The release actuator is also movable to contact the pawl to exert the second force against the pawl. The first and second forces urge the pawl to rotate and disengage the latch portion from the web connector.

20 Claims, 12 Drawing Sheets

(56) References Cited

U.S. PATENT DOCUMENTS 2,393,178 A 1/1946 Manson
2,437,585 A 3/1948 Zimmern
2,482,693 A 9/1949 Rogers et al.
2,538,641 A 1/1951 Elsner
2,549,841 A 4/1951 Morrow et al.
2,639,852 A 5/1953 Sanders et al.
2,641,813 A 6/1953 Loxham
2,668,997 A 2/1954 Irvin et al.
2,710,999 A 6/1955 Davis
2,763,451 A 9/1956 Moran
2,803,864 A 8/1957 Bishaf
2,845,233 A 7/1958 Pfankuch et al.
2,846,745 A 8/1958 Lathrop
2,869,200 A 1/1959 Phillips et al.
2,876,516 A 3/1959 Cummings
2,892,232 A 6/1959 Quilter
2,893,088 A 7/1959 Harper et al.
2,899,732 A 8/1959 Cushman
2,901,794 A 9/1959 Prete, Jr.
2,921,353 A 1/1960 Cushman
2,938,254 A 5/1960 Gaylord
D188,897 S 9/1960 Prete, Jr.
2,964,815 A 12/1960 Sereno
2,965,942 A 12/1960 Carter
3,029,487 A 4/1962 Shinichiro
3,034,596 A 5/1962 Twaits, Jr.
3,084,411 A 4/1963 Lindblad
3,091,010 A 5/1963 Davis
3,104,440 A 9/1963 Davis
3,110,071 A 11/1963 Higuchi
3,118,208 A 1/1964 Wexler
3,132,399 A 5/1964 Cooper
3,137,907 A 6/1964 Unai
D198,566 S 7/1964 Holmberg
3,142,103 A 7/1964 Lindblad
3,142,968 A 8/1964 Basham et al.
3,145,442 A 8/1964 Brown
3,165,805 A 1/1965 Lower
3,178,226 A 4/1965 Cates
3,179,992 A 4/1965 Murphy, Sr.
3,183,568 A 5/1965 Gaylord
3,189,963 A 6/1965 Warner et al.
3,218,685 A 11/1965 Atumi
3,226,791 A 1/1966 Carter
3,233,941 A 2/1966 Selzer
3,256,576 A 6/1966 Klove, Jr. et al.
3,262,169 A 7/1966 Jantzen
3,287,062 A 11/1966 Board et al.
3,289,261 A 12/1966 Davis
3,293,713 A 12/1966 Gaylord
3,306,662 A 2/1967 Finnigan
3,312,502 A 4/1967 Coe
3,323,829 A 6/1967 Liem
3,369,842 A 2/1968 Adams et al.
3,380,776 A 4/1968 Dillender
3,414,947 A 12/1968 Holmberg et al.
3,428,029 A 2/1969 Klickstein et al.
3,451,720 A 6/1969 Makinen
3,473,201 A 10/1969 Hopka et al.
3,491,414 A 1/1970 Stoffel
3,505,711 A 4/1970 Carter
3,523,342 A 8/1970 Spires
D218,589 S 9/1970 Lohr
3,564,672 A 2/1971 McIntyre
3,576,056 A 4/1971 Barcus
3,591,900 A 7/1971 Brown
3,605,207 A 9/1971 Glauser et al.
3,605,210 A 9/1971 Lohr
3,631,571 A 1/1972 Stoffel
3,639,948 A 2/1972 Sherman
3,644,967 A 2/1972 Romanzi, Jr. et al.
3,648,333 A 3/1972 Stoffel
3,658,281 A 4/1972 Gaylord
3,673,645 A 7/1972 Burleigh
3,678,542 A 7/1972 Prete, Jr.
3,695,696 A 10/1972 Lohr et al.
3,714,684 A 2/1973 Gley
3,744,102 A 7/1973 Gaylord
3,744,103 A 7/1973 Gaylord
3,747,167 A 7/1973 Pravaz
3,760,464 A 9/1973 Higuchi
3,766,611 A 10/1973 Gaylord
3,766,612 A 10/1973 Hattori
3,775,813 A 12/1973 Higuchi
3,825,979 A 7/1974 Jakob
3,827,716 A 8/1974 Vaughn et al.
3,856,351 A 12/1974 Garvey
3,879,810 A 4/1975 Prete, Jr. et al.
3,898,715 A 8/1975 Balder
3,935,618 A 2/1976 Fohl
3,964,138 A 6/1976 Gaylord
3,975,800 A 8/1976 Farlind
3,986,234 A 10/1976 Frost et al.
3,995,885 A 12/1976 Plesniarski
4,018,399 A 4/1977 Rex
4,026,245 A 5/1977 Arthur
4,051,743 A 10/1977 Gaylord
4,095,313 A 6/1978 Piljay et al.
D248,618 S 7/1978 Anthony
4,100,657 A 7/1978 Minolla
4,118,833 A 10/1978 Knox et al.
4,128,924 A 12/1978 Happel et al.
4,136,422 A 1/1979 Ivanov et al.
4,148,224 A 4/1979 Craig
4,181,832 A 1/1980 Ueda
4,184,234 A 1/1980 Anthony et al.
4,185,363 A 1/1980 David
4,196,500 A 4/1980 Happel et al.
4,220,294 A 9/1980 Dipaola
4,228,567 A 10/1980 Ikesue et al.
4,239,260 A 12/1980 Hollowell
4,253,623 A 3/1981 Steger et al.
4,262,396 A 4/1981 Koike
4,273,301 A 6/1981 Frankila
4,302,049 A 11/1981 Simpson
4,317,263 A 3/1982 Fohl
4,321,734 A 3/1982 Gandelman
4,323,204 A 4/1982 Takada
4,334,341 A 6/1982 Krautz et al.
4,336,636 A 6/1982 Ishiguro et al.
4,344,588 A 8/1982 Hollowell et al.
4,366,604 A 1/1983 Anthony et al.
4,385,425 A 5/1983 Tanaka et al.
4,403,376 A 9/1983 Palloks
4,408,374 A 10/1983 Fohl
4,419,874 A 12/1983 Brentini
4,425,688 A 1/1984 Anthony et al.
4,428,103 A * 1/1984 Wier ..... A44B 11/2523 24/654
4,454,634 A * 6/1984 Haglund ..... A44B 11/2523 24/636
D274,861 S 7/1984 Lindblad
4,457,052 A 7/1984 Hauber
4,457,251 A 7/1984 Weman et al.
4,487,454 A 12/1984 Biller
4,491,343 A 1/1985 Fohl
4,525,901 A 7/1985 Krauss
4,545,097 A 10/1985 Wier
4,549,769 A 10/1985 Pilarski
4,555,831 A 12/1985 Otzen et al.
4,562,625 A * 1/1986 Doty ..... A44B 11/2523 24/641
4,569,535 A 2/1986 Haglund et al.
4,574,911 A * 3/1986 North ..... B60R 22/321 180/270
4,587,696 A 5/1986 Ueda et al.
D285,383 S 9/1986 Anthony
4,617,705 A 10/1986 Anthony et al.
4,637,102 A 1/1987 Teder et al.
4,638,533 A 1/1987 Gloomis et al.
4,640,550 A 2/1987 Hakansson
4,642,858 A * 2/1987 Ishiguro ..... A44B 11/2523 24/639
4,644,618 A 2/1987 Holmberg et al.

(56) References Cited

U.S. PATENT DOCUMENTS 4,646,400 A 3/1987 Tanaka
4,648,483 A 3/1987 Skyba
4,650,214 A 3/1987 Higbee
4,651,946 A 3/1987 Anthony et al.
4,656,700 A 4/1987 Tanaka et al.
4,660,889 A 4/1987 Anthony et al.
4,679,852 A 7/1987 Anthony et al.
4,682,791 A 7/1987 Ernst
4,685,176 A 8/1987 Burnside
4,692,970 A 9/1987 Anthony et al.
4,711,003 A 12/1987 Gelula
4,716,630 A 1/1988 Skyba
4,720,148 A 1/1988 Anthony et al.
4,726,625 A 2/1988 Bougher
4,727,628 A 3/1988 Rudholm
4,733,444 A * 3/1988 Takada ..... A44B 11/2523 24/641
4,738,485 A 4/1988 Rumpf
4,741,574 A 5/1988 Weightman et al.
4,742,604 A 5/1988 Mazelsky
4,754,105 A * 6/1988 Doty ..... A44B 11/2523 200/61.58 B
D296,678 S 7/1988 Lortz et al.
4,757,579 A 7/1988 Nishino et al.
4,758,048 A 7/1988 Shuman
4,766,654 A 8/1988 Sugimoto
4,786,078 A 11/1988 Schreier et al.
4,786,080 A 11/1988 Jay
4,790,597 A 12/1988 Bauer et al.
4,802,266 A * 2/1989 Doty ..... A44B 11/2523 24/637
4,809,409 A 3/1989 Van Riesen
4,832,410 A 5/1989 Bougher
4,843,688 A 7/1989 Ikeda
4,854,607 A 8/1989 Mandracchia et al.
4,854,608 A 8/1989 Barral
D303,232 S 9/1989 Lortz et al.
4,870,726 A * 10/1989 Eksell ..... A44B 11/2523 24/636
4,876,770 A 10/1989 Bougher
4,876,772 A 10/1989 Anthony et al.
4,884,652 A 12/1989 Vollmer
4,901,407 A 2/1990 Pandola et al.
4,903,377 A 2/1990 Doty
4,911,377 A 3/1990 Lortz et al.
4,919,484 A 4/1990 Bougher et al.
4,920,620 A * 5/1990 Yamamoto ..... A44B 11/2523 200/61.58 B
4,927,211 A 5/1990 Bolcerek
4,934,030 A 6/1990 Spinosa et al.
4,940,254 A 7/1990 Ueno
4,942,649 A 7/1990 Anthony et al.
4,995,640 A 2/1991 Saito
5,014,401 A * 5/1991 Kitazawa ..... A44B 11/2523 24/633
5,015,010 A 5/1991 Homeier et al.
5,023,981 A 6/1991 Anthony et al.
5,026,093 A 6/1991 Nishikaji
5,029,369 A 7/1991 Oberhardt et al.
5,031,962 A 7/1991 Lee
5,038,446 A 8/1991 Anthony et al.
5,039,169 A 8/1991 Bougher et al.
5,046,687 A 9/1991 Herndon
5,050,274 A 9/1991 Staniszewski et al.
5,054,815 A 10/1991 Gavagan
5,058,244 A 10/1991 Fernandez
5,067,212 A 11/1991 Ellis
5,074,011 A 12/1991 Carlson
5,074,588 A 12/1991 Huspen
5,084,946 A 2/1992 Lee
5,088,160 A 2/1992 Warrick
5,088,163 A 2/1992 van Riesen
5,097,572 A 3/1992 Warrick
5,100,176 A 3/1992 Ball et al.
D327,455 S 6/1992 Blair
5,119,532 A 6/1992 Tanaka
5,123,147 A 6/1992 Blair
5,123,673 A 6/1992 Tame
5,142,748 A 9/1992 Anthony et al.
5,159,732 A 11/1992 Burke
5,160,186 A 11/1992 Lee
5,165,149 A 11/1992 Nihei
5,170,539 A 12/1992 Lundstedt et al.
D332,433 S 1/1993 Bougher
5,176,402 A 1/1993 Coulon
5,177,839 A * 1/1993 Seto ..... A44B 11/2523 24/637
5,182,837 A 2/1993 Anthony et al.
5,219,206 A 6/1993 Anthony et al.
5,219,207 A 6/1993 Anthony et al.
5,220,713 A 6/1993 Lane, Jr. et al.
D338,119 S 8/1993 Merrick
5,234,181 A 8/1993 Schroth
5,236,220 A 8/1993 Mills
5,248,187 A 9/1993 Harrison
D342,465 S 12/1993 Anthony et al.
5,267,377 A 12/1993 Gillis et al.
5,269,051 A 12/1993 McFalls
5,272,770 A 12/1993 Allen et al.
5,282,672 A 2/1994 Borlinghaus
5,282,706 A 2/1994 Anthony et al.
5,283,933 A 2/1994 Wiseman et al.
5,286,057 A 2/1994 Forster
5,286,090 A 2/1994 Templin et al.
5,292,181 A 3/1994 Dybro
5,301,371 A 4/1994 Chao
5,306,044 A 4/1994 Tucker
5,308,148 A 5/1994 Peterson et al.
5,311,653 A 5/1994 Merrick
5,332,968 A 7/1994 Brown
5,350,195 A 9/1994 Brown
5,350,196 A 9/1994 Atkins
5,364,048 A 11/1994 Fujimura et al.
5,369,855 A 12/1994 Tokugawa
5,370,333 A 12/1994 Lortz et al.
5,375,879 A 12/1994 Williams et al.
5,380,066 A 1/1995 Wiseman et al.
5,392,535 A 2/1995 Van Noy et al.
5,397,171 A 3/1995 Leach
5,403,038 A 4/1995 Mcfalls
5,406,681 A 4/1995 Olson
5,411,292 A 5/1995 Collins et al.
5,416,957 A 5/1995 Renzi, Sr. et al.
D359,710 S 6/1995 Chinni et al.
5,432,987 A 7/1995 Schroth
5,435,272 A 7/1995 Epstein
5,443,302 A 8/1995 Dybro
D362,415 S 9/1995 Takimoto
5,451,094 A 9/1995 Templin et al.
D364,124 S 11/1995 Lortz et al.
5,471,714 A 12/1995 Olson
5,495,646 A 3/1996 Scrutchfield et al.
5,497,956 A 3/1996 Crook
5,511,856 A 4/1996 Merrick et al.
5,516,199 A 5/1996 Crook et al.
5,526,556 A 6/1996 Czank
5,540,403 A 7/1996 Standley
5,560,565 A 10/1996 Merrick et al.
5,561,891 A 10/1996 Hsieh
5,566,431 A 10/1996 Haglund
5,568,676 A 10/1996 Freeman
5,570,933 A 11/1996 Rouhana et al.
5,577,683 A 11/1996 Imai
5,579,785 A 12/1996 Bell
5,584,107 A 12/1996 Koyanagi et al.
5,588,189 A 12/1996 Gorman et al.
5,606,783 A 3/1997 Gillis et al.
5,622,327 A 4/1997 Heath et al.
5,628,548 A 5/1997 Lacoste
5,634,664 A 6/1997 Seki et al.
5,640,468 A 6/1997 Hsu
5,669,572 A 9/1997 Crook
5,695,243 A 12/1997 Anthony et al.

(56) References Cited

U.S. PATENT DOCUMENTS 5,699,594 A 12/1997 Czank et al.
D389,426 S 1/1998 Merrick et al.
5,722,689 A 3/1998 Chen et al.
5,743,597 A 4/1998 Jessup et al.
5,765,774 A 6/1998 Maekawa et al.
5,774,947 A 7/1998 Anscher
5,779,319 A 7/1998 Merrick
D397,063 S 8/1998 Woellert et al.
5,788,281 A 8/1998 Yanagi et al.
5,788,282 A 8/1998 Lewis
5,794,878 A 8/1998 Carpenter et al.
5,806,148 A 9/1998 Mcfalls et al.
5,813,097 A 9/1998 Woellert et al.
5,839,793 A 11/1998 Merrick et al.
5,857,247 A 1/1999 Warrick et al.
5,873,599 A 2/1999 Bauer et al.
5,873,635 A 2/1999 Merrick
5,882,084 A 3/1999 Verellen et al.
D407,667 S 4/1999 Homeier
5,908,223 A 6/1999 Miller
5,915,630 A 6/1999 Step
5,934,760 A 8/1999 Schroth
D416,827 S 11/1999 Anthony et al.
5,979,026 A 11/1999 Anthony
5,979,982 A 11/1999 Nakagawa
5,996,192 A 12/1999 Haines et al.
6,003,899 A 12/1999 Chaney
6,017,087 A 1/2000 Anthony et al.
6,056,320 A 5/2000 Khalifa et al.
6,065,367 A 5/2000 Schroth
6,065,777 A 5/2000 Merrick
6,123,388 A 9/2000 Vits et al.
6,182,783 B1 2/2001 Bayley
RE37,123 E 4/2001 Templin et al.
6,224,154 B1 5/2001 Stoki
6,230,370 B1 5/2001 Nelsen
6,260,884 B1 7/2001 Bittner et al.
6,295,700 B1 10/2001 Plzak
6,309,024 B1 10/2001 Busch
6,312,015 B1 11/2001 Merrick et al.
6,315,232 B1 11/2001 Merrick
6,322,140 B1 11/2001 Jessup et al.
6,322,149 B1 11/2001 Conforti et al.
6,325,412 B1 12/2001 Pan
6,328,379 B1 12/2001 Merrick et al.
6,343,841 B1 2/2002 Gregg et al.
6,351,717 B2 2/2002 Lambrecht
6,357,790 B1 3/2002 Swann et al.
6,358,591 B1 3/2002 Smith
6,363,591 B1 4/2002 Bell et al.
6,367,882 B1 4/2002 Van Druff et al.
6,374,168 B1 4/2002 Fujii
6,400,145 B1 6/2002 Chamings et al.
6,412,863 B1 7/2002 Merrick et al.
6,418,596 B2 7/2002 Haas
6,425,632 B1 7/2002 Anthony et al.
6,442,807 B1 9/2002 Adkisson
6,446,272 B1 9/2002 Lee
6,463,638 B1 10/2002 Pontaoe
6,467,849 B1 10/2002 Deptolla
6,485,057 B1 11/2002 Midorikawa et al.
6,485,098 B1 11/2002 Vits et al.
6,508,515 B2 1/2003 Vits et al.
6,513,208 B1 2/2003 Sack et al.
6,520,392 B2 2/2003 Thibodeau et al.
6,543,101 B2 4/2003 Sack et al.
6,547,273 B2 4/2003 Grace et al.
6,560,825 B2 5/2003 Maciejczyk
6,566,869 B2 5/2003 Chamings et al.
6,588,077 B2 7/2003 Katsuyama et al.
6,592,149 B2 7/2003 Sessoms
6,606,770 B1 8/2003 Badrenas Buscart
6,619,753 B2 9/2003 Takayama
6,631,926 B2 10/2003 Merrick et al.
6,665,912 B2 12/2003 Turner et al.
6,694,577 B2 2/2004 Di Perrero
6,711,790 B2 3/2004 Pontaoe
6,719,233 B2 4/2004 Specht et al.
6,719,326 B2 4/2004 Schroth et al.
6,722,601 B2 4/2004 Kohlndorfer et al.
6,722,697 B2 4/2004 Krauss et al.
6,733,041 B2 5/2004 Arnold et al.
6,739,541 B2 5/2004 Palliser et al.
6,749,150 B2 6/2004 Kohlndorfer et al.
6,763,557 B2 7/2004 Steiff et al.
6,769,157 B1 8/2004 Meal
6,786,294 B2 9/2004 Specht
6,786,510 B2 9/2004 Roychoudhury et al.
6,786,511 B2 9/2004 Heckmayr
6,793,291 B1 9/2004 Kocher
6,796,007 B1 9/2004 Anscher
6,802,470 B2 10/2004 Smithson et al.
6,820,310 B2 11/2004 Woodard et al.
6,820,902 B2 11/2004 Kim
6,834,822 B2 12/2004 Koning et al.
6,836,754 B2 12/2004 Cooper
6,837,519 B2 1/2005 Moskalik et al.
6,840,544 B2 1/2005 Prentkowski
6,851,160 B2 2/2005 Carver
6,857,326 B2 2/2005 Specht et al.
6,860,671 B2 3/2005 Schulz
6,863,235 B2 3/2005 Koning et al.
6,863,236 B2 3/2005 Kempf et al.
6,868,585 B2 3/2005 Anthony et al.
6,868,591 B2 3/2005 Dingman et al.
6,871,876 B2 3/2005 Xu
6,874,819 B2 4/2005 O'Neill
6,882,914 B2 4/2005 Gioutsos et al.
6,886,889 B2 5/2005 Vits et al.
6,896,291 B1 5/2005 Peterson
6,902,193 B2 6/2005 Kim et al.
6,913,288 B2 7/2005 Schulz et al.
6,916,045 B2 7/2005 Clancy, III et al.
6,921,136 B2 7/2005 Bell et al.
6,922,875 B2 8/2005 Sato et al.
6,931,669 B2 8/2005 Ashline
6,935,701 B1 8/2005 Arnold et al.
6,951,350 B2 10/2005 Heidorn et al.
6,957,789 B2 10/2005 Bowman et al.
6,959,946 B2 11/2005 Desmarais et al.
6,962,394 B2 11/2005 Anthony et al.
6,966,518 B2 11/2005 Kohlndorfer et al.
6,969,022 B2 11/2005 Bell et al.
6,969,122 B2 11/2005 Sachs et al.
6,993,436 B2 1/2006 Specht et al.
6,997,474 B2 2/2006 Midorikawa et al.
6,997,479 B2 2/2006 Desmarais et al.
7,010,836 B2 3/2006 Acton et al.
D519,406 S 4/2006 Merrill et al.
7,025,297 B2 4/2006 Bell et al.
7,029,067 B2 4/2006 Vits et al.
7,040,696 B2 5/2006 Vits et al.
7,065,843 B1 6/2006 Wu
7,073,866 B1 7/2006 Berdahl
7,077,475 B2 7/2006 Boyle
7,080,856 B2 7/2006 Desmarais et al.
7,083,147 B2 8/2006 Movsesian et al.
7,093,331 B1 * 8/2006 Holmberg ..... A44B 11/2546 24/633
7,100,991 B2 9/2006 Schroth
7,108,114 B2 9/2006 Mod et al.
7,118,133 B2 10/2006 Bell et al.
7,131,667 B2 11/2006 Bell et al.
7,137,648 B2 11/2006 Schulz et al.
7,137,650 B2 11/2006 Bell et al.
7,140,571 B2 11/2006 Hishon et al.
7,144,085 B2 12/2006 Vits et al.
7,147,251 B2 12/2006 Bell et al.
D535,214 S 1/2007 Kolasa
7,159,285 B2 1/2007 Karlsson
7,180,258 B2 2/2007 Specht et al.
7,182,370 B2 2/2007 Arnold
7,210,707 B2 5/2007 Schroth
7,216,827 B2 5/2007 Tanaka et al.

(56) References Cited

U.S. PATENT DOCUMENTS

| | | | |
|---|---|---|---|
| 7,219,929 | B2 | 5/2007 | Bell et al. |
| 7,232,154 | B2 | 6/2007 | Desmarais et al. |
| 7,237,741 | B2 | 7/2007 | Specht |
| 7,240,405 | B2 | 7/2007 | Webber et al. |
| 7,240,924 | B2 | 7/2007 | Kohlndorfer et al. |
| 7,246,854 | B2 | 7/2007 | Dingman et al. |
| 7,263,750 | B2 | 9/2007 | Keene et al. |
| 7,278,684 | B2 | 10/2007 | Boyle |
| D555,358 | S | 11/2007 | King |
| 7,300,013 | B2 | 11/2007 | Morgan et al. |
| 7,341,216 | B2 | 3/2008 | Heckmayr |
| 7,360,287 | B2 | 4/2008 | Cerruti et al. |
| 7,367,590 | B2 | 5/2008 | Koning et al. |
| 7,377,464 | B2 | 5/2008 | Morgan |
| 7,384,014 | B2 | 6/2008 | Ver Hoven et al. |
| 7,395,585 | B2 | 7/2008 | Longley et al. |
| 7,404,239 | B1 | 7/2008 | Walton et al. |
| 7,407,193 | B2 | 8/2008 | Yamaguchi et al. |
| D578,931 | S | 10/2008 | Toltzman et al. |
| 7,452,003 | B2 | 11/2008 | Bell |
| 7,455,256 | B2 | 11/2008 | Morgan |
| 7,461,866 | B2 | 12/2008 | Desmarais et al. |
| 7,475,840 | B2 | 1/2009 | Heckmayr |
| 7,477,139 | B1 | 1/2009 | Cuevas |
| 7,481,399 | B2 | 1/2009 | Nöhren et al. |
| 7,506,413 | B2 | 3/2009 | Dingman et al. |
| 7,516,808 | B2 | 4/2009 | Tanaka |
| 7,520,036 | B1 | 4/2009 | Baldwin et al. |
| D592,543 | S | 5/2009 | Kolasa |
| D592,830 | S | 5/2009 | Whiteside |
| 7,533,902 | B2 | 5/2009 | Arnold et al. |
| 7,547,043 | B2 | 6/2009 | Kokeguchi et al. |
| D603,753 | S | 11/2009 | Palmer et al. |
| 7,614,124 | B2 | 11/2009 | Keene et al. |
| 7,631,830 | B2 | 12/2009 | Boelstler et al. |
| 7,669,794 | B2 | 3/2010 | Boelstler et al. |
| 7,673,945 | B1 | 3/2010 | Riffel et al. |
| 7,698,791 | B2 | 4/2010 | Pezza |
| 7,716,794 | B2 | 5/2010 | Wu |
| 7,716,795 | B2 | 5/2010 | Versellie et al. |
| 7,722,081 | B2 | 5/2010 | Van Druff et al. |
| 7,739,019 | B2 | 6/2010 | Robert et al. |
| 7,753,410 | B2 | 7/2010 | Coultrup |
| 7,775,557 | B2 | 8/2010 | Boström et al. |
| 7,794,024 | B1 | 9/2010 | Kranz et al. |
| RE41,790 | E | 10/2010 | Stanley |
| 7,861,341 | B2 | 1/2011 | Ayette et al. |
| 7,862,124 | B2 | 1/2011 | Dingman |
| 7,871,132 | B2 | 1/2011 | Rogers |
| D632,611 | S | 2/2011 | Buscart |
| D637,518 | S | 5/2011 | Chen |
| 7,934,775 | B2 | 5/2011 | Walker et al. |
| 7,945,975 | B2 | 5/2011 | Thomas et al. |
| 8,011,730 | B2 | 9/2011 | Greenwood |
| 8,037,581 | B2 | 10/2011 | Gray et al. |
| 8,096,027 | B2 | 1/2012 | Jung et al. |
| 8,240,012 | B2 | 8/2012 | Walega et al. |
| 8,240,767 | B2 | 8/2012 | Greenwood |
| 8,256,073 | B2 | 9/2012 | Zhang |
| 8,375,531 | B2 * | 2/2013 | Lee ..... A44B 11/2573 24/633 |
| 8,381,373 | B2 | 2/2013 | Jung |
| 8,387,216 | B1 | 3/2013 | Martinson |
| 8,468,660 | B2 | 6/2013 | Holler |
| 8,567,022 | B2 | 10/2013 | Keene et al. |
| 8,627,554 | B1 | 1/2014 | Hagan et al. |
| D729,119 | S | 5/2015 | Janes |
| 2002/0089163 | A1 | 7/2002 | Bedewi et al. |
| 2002/0135175 | A1 | 9/2002 | Schroth |
| 2002/0145279 | A1 | 10/2002 | Murray |
| 2003/0015863 | A1 | 1/2003 | Brown et al. |
| 2003/0027917 | A1 | 2/2003 | Namiki et al. |
| 2003/0085608 | A1 | 5/2003 | Girardin |
| 2004/0066291 | A1 | 4/2004 | Tracy et al. |
| 2004/0084953 | A1 | 5/2004 | Hansen |
| 2004/0169411 | A1 | 9/2004 | Murray |
| 2004/0174063 | A1 | 9/2004 | Kocher |
| 2004/0217583 | A1 | 11/2004 | Wang |
| 2004/0227390 | A1 | 11/2004 | Schroth |
| 2004/0251367 | A1 | 12/2004 | Suzuki et al. |
| 2005/0073187 | A1 | 4/2005 | Frank et al. |
| 2005/0107932 | A1 | 5/2005 | Bolz et al. |
| 2005/0127660 | A1 | 6/2005 | Liu |
| 2005/0175253 | A1 | 8/2005 | Li et al. |
| 2005/0179244 | A1 | 8/2005 | Schroth |
| 2005/0206151 | A1 | 9/2005 | Ashline |
| 2005/0284977 | A1 | 12/2005 | Specht et al. |
| 2006/0071535 | A1 | 4/2006 | Kim et al. |
| 2006/0075609 | A1 | 4/2006 | Dingman et al. |
| 2006/0090313 | A1 | 5/2006 | Muromachi et al. |
| 2006/0097095 | A1 | 5/2006 | Boast |
| 2006/0237573 | A1 | 10/2006 | Boelstler et al. |
| 2006/0243070 | A1 | 11/2006 | Van Druff et al. |
| 2006/0267394 | A1 | 11/2006 | David et al. |
| 2006/0277727 | A1 | 12/2006 | Keene et al. |
| 2007/0052255 | A1 | 3/2007 | O'Connor |
| 2007/0080528 | A1 | 4/2007 | Itoga et al. |
| 2007/0241549 | A1 | 10/2007 | Boelstler et al. |
| 2007/0257480 | A1 | 11/2007 | Van Druff et al. |
| 2008/0018156 | A1 | 1/2008 | Hammarskjold et al. |
| 2008/0030013 | A1 | 2/2008 | Burghardt |
| 2008/0054615 | A1 | 3/2008 | Coultrup |
| 2008/0087754 | A1 | 4/2008 | Aihara et al. |
| 2008/0093833 | A1 | 4/2008 | Odate |
| 2008/0100051 | A1 | 5/2008 | Bell et al. |
| 2008/0100122 | A1 | 5/2008 | Bell et al. |
| 2008/0136246 | A1 | 6/2008 | Salter |
| 2008/0172847 | A1 | 7/2008 | Keene et al. |
| 2008/0224460 | A1 | 9/2008 | Erez |
| 2009/0014991 | A1 | 1/2009 | Smyth et al. |
| 2009/0069983 | A1 | 3/2009 | Humbert et al. |
| 2009/0179412 | A1 | 7/2009 | Gray et al. |
| 2009/0183348 | A1 * | 7/2009 | Walton ..... A44B 11/2511 24/633 |
| 2009/0212549 | A1 | 8/2009 | Jones |
| 2009/0241305 | A1 | 10/2009 | Buckingham |
| 2010/0046843 | A1 | 2/2010 | Ma et al. |
| 2010/0115737 | A1 | 5/2010 | Foubert |
| 2010/0125983 | A1 | 5/2010 | Keene et al. |
| 2010/0146749 | A1 | 6/2010 | Jung |
| 2010/0213753 | A1 | 8/2010 | Humbert |
| 2010/0219667 | A1 | 9/2010 | Merrill et al. |
| 2011/0010901 | A1 | 1/2011 | Holler |
| 2011/0043402 | A1 | 2/2011 | Sasakawa |
| 2011/0057500 | A1 | 3/2011 | Walker et al. |
| 2011/0162175 | A1 | 7/2011 | Gnesda et al. |
| 2012/0242134 | A1 | 9/2012 | Siegel |
| 2012/0284966 | A1 | 11/2012 | Greaves et al. |
| 2012/0292893 | A1 | 11/2012 | Baca et al. |
| 2013/0127229 | A1 | 5/2013 | Humbert |
| 2013/0212845 | A1 | 8/2013 | Ford et al. |
| 2014/0230202 | A1 | 8/2014 | Humbert et al. |

FOREIGN PATENT DOCUMENTS

| | | | |
|---|---|---|---|
| CA | 2091526 | A1 | 10/1993 |
| CA | 2112960 | C | 12/2002 |
| CA | 2450744 | A1 | 2/2003 |
| DE | 4019402 | A1 | 12/1991 |
| DE | 69019765 | T2 | 7/1995 |
| DE | 4421688 | C1 | 12/1995 |
| EP | 0026564 | A1 | 4/1981 |
| EP | 0254383 | A2 | 1/1988 |
| EP | 0363062 | A2 | 4/1990 |
| EP | 0380442 | A2 | 8/1990 |
| EP | 0401455 | A1 | 12/1990 |
| EP | 0404730 | A1 | 12/1990 |
| EP | 0449772 | A1 | 10/1991 |
| EP | 0519296 | A1 | 12/1992 |
| EP | 0561274 | A1 | 9/1993 |
| EP | 0608564 | A1 | 8/1994 |
| EP | 1153789 | A2 | 11/2001 |
| EP | 1447021 | A1 | 8/2004 |
| FR | 1298012 | A | 7/1962 |

(56) References Cited

FOREIGN PATENT DOCUMENTS

| | | | |
|---|---|---|---|
| GB | 888436 | A | 1/1962 |
| GB | 1047761 | | 11/1966 |
| GB | 1582973 | A | 1/1981 |
| GB | 2055952 | A | 3/1981 |
| GB | 2356890 | A | 6/2001 |
| JP | 52055120 | A | 5/1977 |
| JP | 63141852 | A | 6/1988 |
| JP | 63247150 | A | 10/1988 |
| JP | 10119611 | A | 5/1998 |
| JP | 2001138858 | A | 5/2001 |
| WO | 1986003386 | A | 6/1986 |
| WO | 2003009717 | A2 | 2/2003 |
| WO | 2004004507 | A1 | 1/2004 |
| WO | 2006041859 | | 4/2006 |
| WO | 2010027853 | A1 | 3/2010 |

OTHER PUBLICATIONS

Holmbergs, "Art.No. 63/4959-XX and 63/4958-XX GR.1 Buckle, 3/5 point," accessed Sep. 15, 2010, www.holmbergs.se, 2 pages.
Holmbergs, "GR. 0+ 3-point buckle with plastic chassis and tongues," accessed Sep. 15, 2010, http://www.holmbergs.se/1/1.0.1.0/70/1/, 1 page.
Holmbergs, "Gr. 1 Buckle, Viking," accessed Sep. 15, 2010, http://www.holmbergs.se1/1/1.0.1.0/53/1/, 1 page.
Holmbergs, "Group 1 Systems," accessed Sep. 15, 2010, http://www.holmbergs.se/1/1.0.1.0/87/1/, 1 page.
Holmbergs, "Infant buckle with steel tongues," accessed Sep. 15, 2010, http://www.holmbergs.se/1/1.0.1.0/74/1/, 1 page.
Holmbergs, "Infant buckle. 5-point with plastic chassi and plastic tongues," accessed Sep. 15, 2010, http://www.holmbergs.se/1/1.0.1.0/73/1/, 1 page.
International Search Report dated Jan. 12, 2017, International Application No. PCT/US2016/064599, 10 pages.
Novarace, "DL: Group 1 Buckle," accessed Sep. 15, 2010, http://www.novarace.com/index.php?option=com_content&task=view&id=36&Itemid=48, 1 page.
Novarace, "GT 3: Group 0 Buckle," accessed Sep. 15, 2010, http://www.novarace.com/index.php?option=com_content&task=view&id=33&Itemid=46, 1 page.
Novarace, "GT 5: Group 0 Buckle," accessed Sep. 15, 2010, http://www.novarace.com/index.php?option=com_content&task=view&id=30&Itemid=44, 1 page.
Novarace, "GT: Group 1 Buckle," accessed Oct. 8, 2010, http://www.novarace.com/gt.htm, 1 page.
Novarace, "KMA 1: Group 1 Buckle," accessed Sep. 15, 2010, http://www.novarace.com/index.php?option=com_content&task=view&id=34&Itemid=47, 1 page.
Sabelt Catalog, "SAB104: Standard tongue hole to facilitate webbing insert," p. 23, 1 page.
Sabelt, "Daphne 0: Fiberglass-plastic buckle with metal pin latch," accessed Sep. 15, 2010, http://childsafety.sabelt.com/index.php/eshop/product/Sabelt-Racing-DAPHNE-0.html/1/, 1 page.
Sabelt, "RO1000: Fiberglass-plastic buckle with metal pin latch," accessed Sep. 15, 2010, http://childsafety.sabelt.com/index.php/eshop/product/Sabelt-Racing_RO1000.html/1/pid/1 , 1 page.
Sabelt, "SAB004: Fiberglass-plastic buckle with metal pin latch," accessed Sep. 15, 2010, http://childsafety.sabelt.com/index.php/eshop/product/Sabelt-Racing-SAB004.html/1/pid/1, 1 page.
Sabelt, "SABUSA004: Fiberglass-plastic buckle with metal pin latch," accessed Sep. 15, 2010, http://childsafety.sabelt.com/index.php/eshop/product/Sabelt-Racing-SABUSA004.html/1/, 1 page.

* cited by examiner

HARSH ENVIRONMENT BUCKLE ASSEMBLIES AND ASSOCIATED SYSTEMS AND METHODS

TECHNICAL FIELD

The following disclosure relates generally to buckle assemblies for use in personal restraint systems and, more particularly, to buckle assemblies and associated systems and methods that are adapted for use in harsh environments.

BACKGROUND

A variety of vehicles include restraint systems to help restrain operators or passengers while the vehicles are in motion. Many of these restraint systems have buckles or other components that are releasably fastened together to connect two or more pieces of webbing. For example, seatbelts in most passenger vehicles include a buckle that is attached to a first piece of webbing. To secure a vehicle occupant, a tongue that is connected to a second piece of webbing is releasably engaged by the buckle. In most restraint systems, buckles generally have multiple internal components that are moveable to provide for releasable engagement of the tongue. For example, buttons, latches, springs and other components are often used to provide a releasable engagement mechanism. As with many mechanical devices, the operation of these components may be affected by the environment in which they operate.

Some vehicle types, e.g., off-road recreational utility vehicles (RUVs), are frequently operated in harsh environments that can expose restraint system components to a variety of contaminants. Exposing buckles or other components to mud, sand, water, and/or other contaminants, can affect the operation of the restraint system. In some cases, the contamination can restrict or prevent movement of a release button or other component that is necessary to release the tongue from the buckle. In other cases, contamination can restrict insertion of the tongue into the buckle. Cleaning, repairing or replacing buckles and other components to address such occurrences can require substantial time and expense.

DETAILED DESCRIPTION

Figure 1:
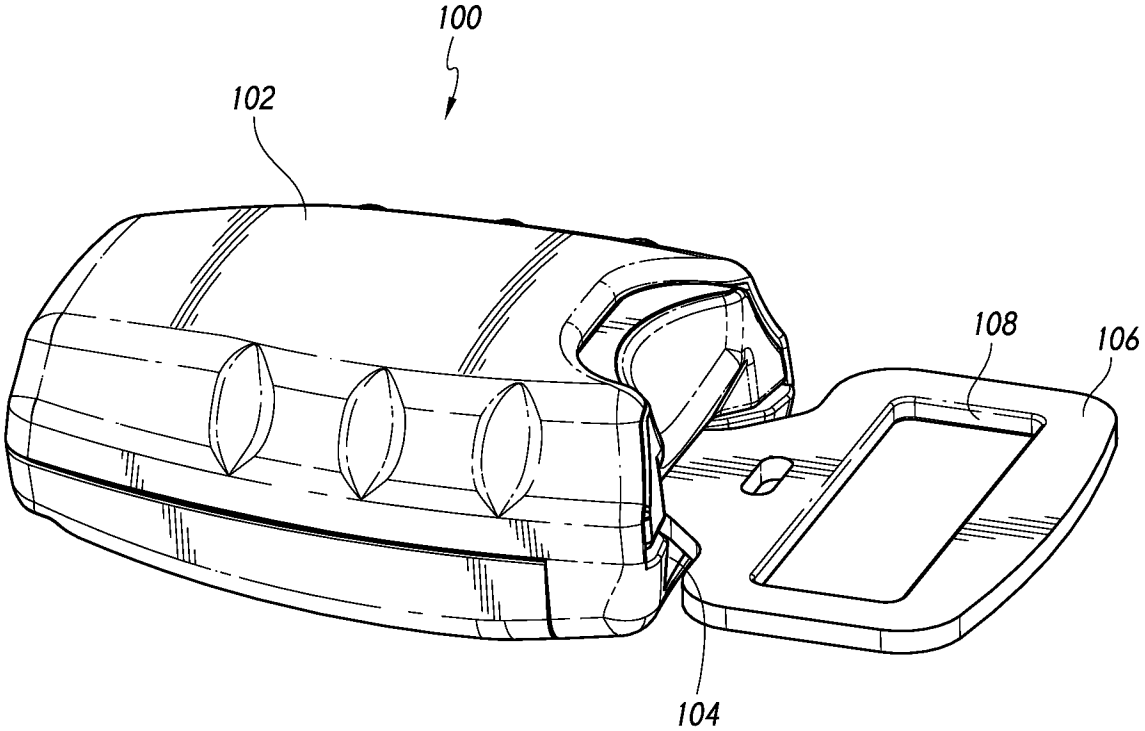
FIG. 1 is an isometric view of a connector joined to a buckle assembly configured in accordance with an embodiment of the present technology.

The following disclosure describes various embodiments of buckle assemblies and associated systems and methods.

In some embodiments, a buckle assembly for a personal restraint system includes a release actuator (e.g., a button) that can apply increased force to release a web connector. For example, a buckle assembly configured in accordance with one embodiment of the present technology includes a frame having a pair of opposing openings and a pawl pivotally mounted to the frame via the opposing openings. The pawl includes a latch portion positioned to releasably engage a web connector, and a biasing member is operably positioned between the release actuator and the pawl. The release actuator is movable to a first position to compress the biasing member and exert a first force against the pawl. The release actuator is also movable to a second position to further compress the biasing member and directly contact the pawl to exert a second force against the pawl. The second force can be greater than the first force, and the first and second forces together urge the pawl to rotate and disengage the latch portion from the web connector.

In several embodiments, buckle assemblies can include an ejector that urges a web connector out of the buckle assembly when the release actuator is operated. The ejector can also operate to engage the latch portion with the web connector. For example, insertion of a web connector into the buckle assembly can drive the ejector against the pawl to rotate the pawl and engage the latch portion with the web connector. In other embodiments, the devices, systems and associated methods can have different configurations, components, and/or procedures. Still other embodiments may eliminate particular components and/or procedures. A person of ordinary skill in the relevant art, therefore, will understand that the present technology, which includes associated devices, systems, and procedures, may include other embodiments with additional elements or steps, and/or may include other embodiments without several of the features or steps shown and described below with reference to FIGS. 1 to 9.

As discussed above, exposure of personal restraint systems to harsh environments can affect the operation of various components. The present technology includes several embodiments of buckle assemblies and restraint system components that can mitigate the impact of harsh environments and contaminants. Certain details are set forth in the following description and FIGS. 1 to 9 to provide a thorough understanding of various embodiments of the disclosure. To avoid unnecessarily obscuring the description of the various embodiments of the disclosure, other details describing well-known structures and systems often associated with buckle assemblies, personal restraint systems, and the components or devices associated with the manufacture of buckle assemblies and personal restraint systems are not set forth below. Moreover, many of the details and features shown in the Figures are merely illustrative of particular embodiments of the disclosure. Accordingly, other embodiments can have other details and features without departing from the spirit and scope of the present disclosure. In addition, the various elements and features illustrated in the Figures may not be drawn to scale. Furthermore, various embodiments of the disclosure can include structures other than those illustrated in the Figures and are expressly not limited to the structures shown in the Figures.

FIG. 1 is an isometric view of a buckle assembly 100 configured in accordance with an embodiment of the present disclosure. In the illustrated embodiment, the buckle assembly 100 includes a housing 102 having an opening 104. A web connector 106 having a web opening 108 can be inserted into the opening 104 to couple the web connector 106 to the buckle assembly 100. A web (e.g., a seat belt web)

or other restraint system component can be coupled to the web connector 106 via the opening 108 in a conventional manner to secure an occupant of a vehicle in his or her seat. For example, a portion of a lap belt (not shown) can be fastened to the connector 106 via the web opening 108.

Figure 2:
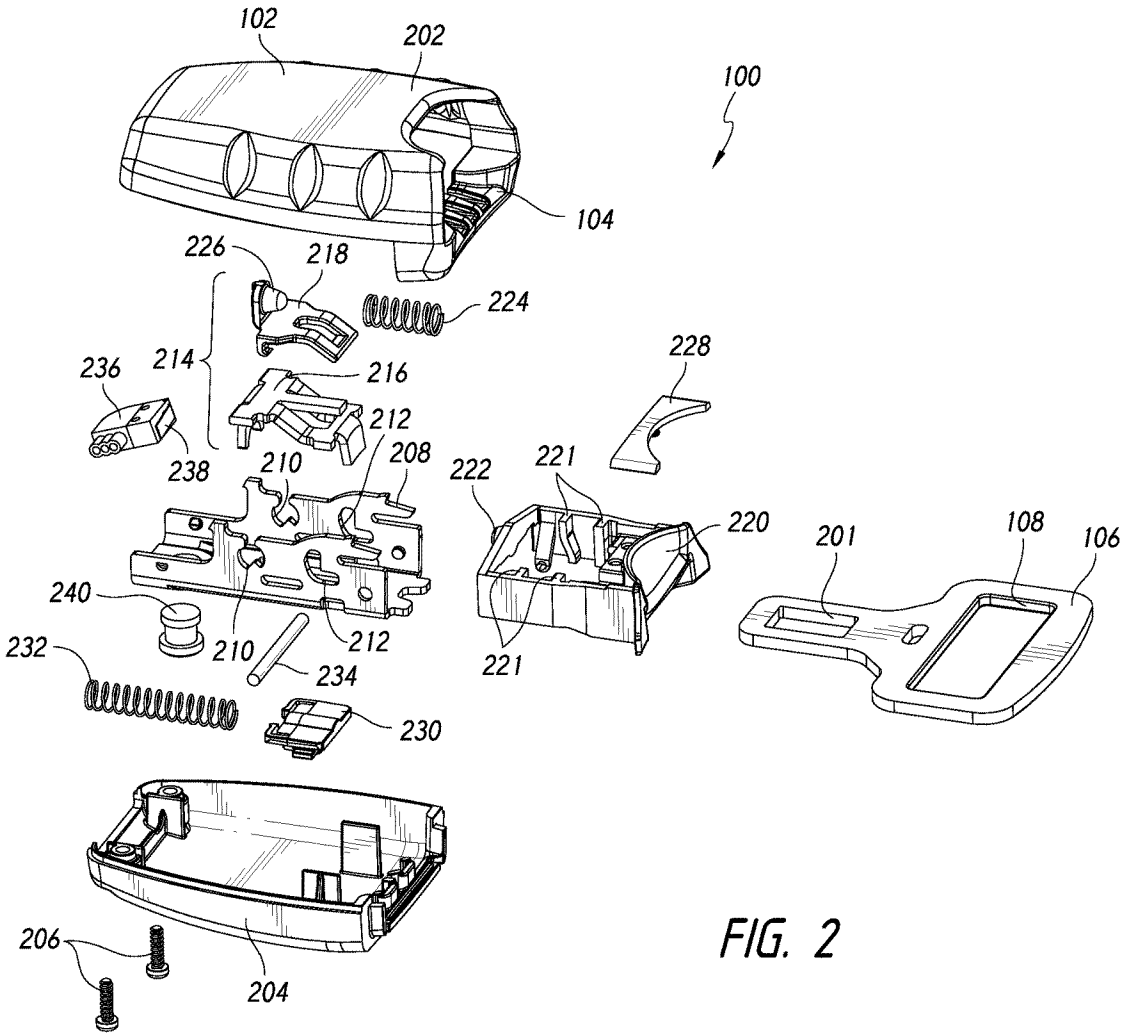
FIG. 2 is an exploded isometric view of the buckle assembly and connector configured in accordance with an embodiment of the present technology.

FIG. 2 is an exploded isometric view of the buckle assembly 100 and the connector 106 configured in accordance with an embodiment of the present technology. In the illustrated embodiment of FIG. 2, the housing 102 includes an upper portion 202 and a lower portion 204. The upper portion 202 is removably secured to the lower portion 204 via a pair of fasteners (e.g., screws) 206. The buckle assembly 100 also includes a frame 208 having a pair of first openings 210 and a pair of second openings 212. A pawl 214 includes a latch portion 216 and a drive portion 218. As described in more detail below, the pawl 214 can be pivotally coupled to the frame to releasably engage the connector 106 via a latch opening 201.

The buckle assembly 100 also includes a release actuator 220 (e.g., a release button) that can be slidably coupled to the frame 208. The release actuator 220 includes a plurality of guide features 221 and a first biasing member mount 222 (e.g., a first spring mount) that can engage an end portion of a first biasing member 224 (e.g., a first spring). The drive portion 218 includes a second biasing member mount 226 (e.g., a second spring mount) that can engage an opposite end portion of the first spring 224. The first spring 224 can be positioned to extend between the first spring mount 222 and the second spring mount 226, and the first spring 224 can bias the release actuator 220 toward the opening 104. The release actuator 220 slidably straddles the frame 208 and can be actuated to release the connector 106 by depressing the actuator 220 into the opening 104, as described in more detail below. A release actuator insert 228 is positioned between the housing upper portion 202 and the release actuator 220. The insert 228 contacts features on the frame 208 to provide a hard stop when the release actuator 220 is fully depressed into the opening 104. The components of the buckle assembly 100 can be constructed from a variety of materials. For example, in some embodiments, the frame 108, the latch portion 216 of the pawl 214, and/or other components can be constructed from metal or metal alloys (e.g., steel). Additionally, in several embodiments, the housing 102, the release button 220, the drive portion 218 of the pawl 214, and/or other components can be constructed from a variety of plastics (e.g., high-density polyethylene (HDPE)).

An ejector 230 is slidably coupled to the frame 208 and biased toward the opening 104 by a second biasing member 232 (e.g., a second spring). When the release actuator 220 is actuated to unlatch the connector 106 from the buckle assembly 100, the second spring 232 can urge the ejector 230 to push the connector 106 out of the opening 104. A locking pin 234 can be movably received in the second openings 212 of the frame 208, and can be driven by the guide features 221 of the release actuator 220. The locking pin 234 can also interact with the pawl 214 to prevent inadvertent release of the connector 106.

The buckle assembly 100 can further include a switch 236 having an actuator 238 (e.g., an actuation lever). The pawl 214 can engage the actuator 238 to provide an indication of the status of the buckle assembly (e.g., unlatched or latched). Additionally, a coupling member 240 can couple a tang (not shown) to the frame 208. The tang can be coupled to a piece of webbing or another restraint system component to secure the buckle assembly 100 to an associated vehicle. In some embodiments, the tang and/or the frame can include load absorbing features that can interact with the coupling member 240 and provide for relative motion between the frame 208 and the tang. The relative motion can be used to provide an indication that the buckle assembly 100 has been subjected to a load sufficient to warrant repair or replacement of the buckle assembly 100. In several embodiments, such load absorbing and indicating features can be at least generally similar to those described in U.S. Patent Application No. 62/236,792, filed Oct. 2, 2015, and entitled Load Indicators for Personal Restraint Systems and Associated Systems and Methods, which is incorporated by reference herein in its entirety. The switch 236 can be coupled to a load indicating component, the housing 102, or another component of the buckle assembly 100 such that the actuator 238 is positioned to be actuated via the pawl 214, as discussed in more detail below.

Figure 3:
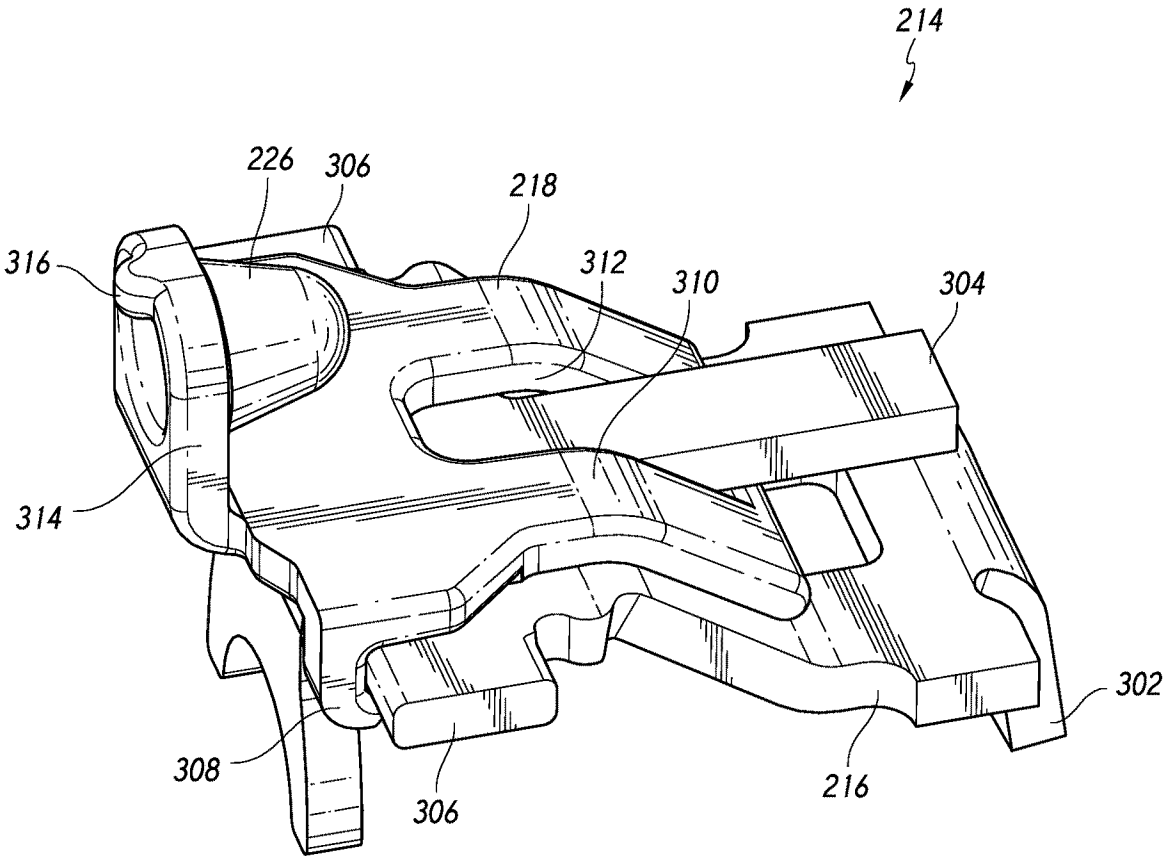
FIG. 3 is an enlarged isometric view of a pawl configured in accordance with an embodiment of the present technology.

FIG. 3 is an enlarged isometric view of the pawl 214 configured in accordance with an embodiment of the present technology. In the illustrated embodiment, the latch portion 216 includes a latch arm 302, a locking arm 304, and a pair of opposing tabs 306. The drive portion 218 includes a pair of hooks 308 (only one visible in FIG. 3), and a curved body 310 having a slot 312. The drive portion 218 can be coupled to the latch portion 216 via extension of the locking arm 304 through the slot 312, and engagement of the hooks 308 with the tabs 306. The drive portion 218 further includes an actuation arm 314 having the second spring mount 226 and a protrusion with a contact surface 316. The contact surface 316 can engage the actuation lever 238 on the switch 236 (FIG. 2).

Figure 4:
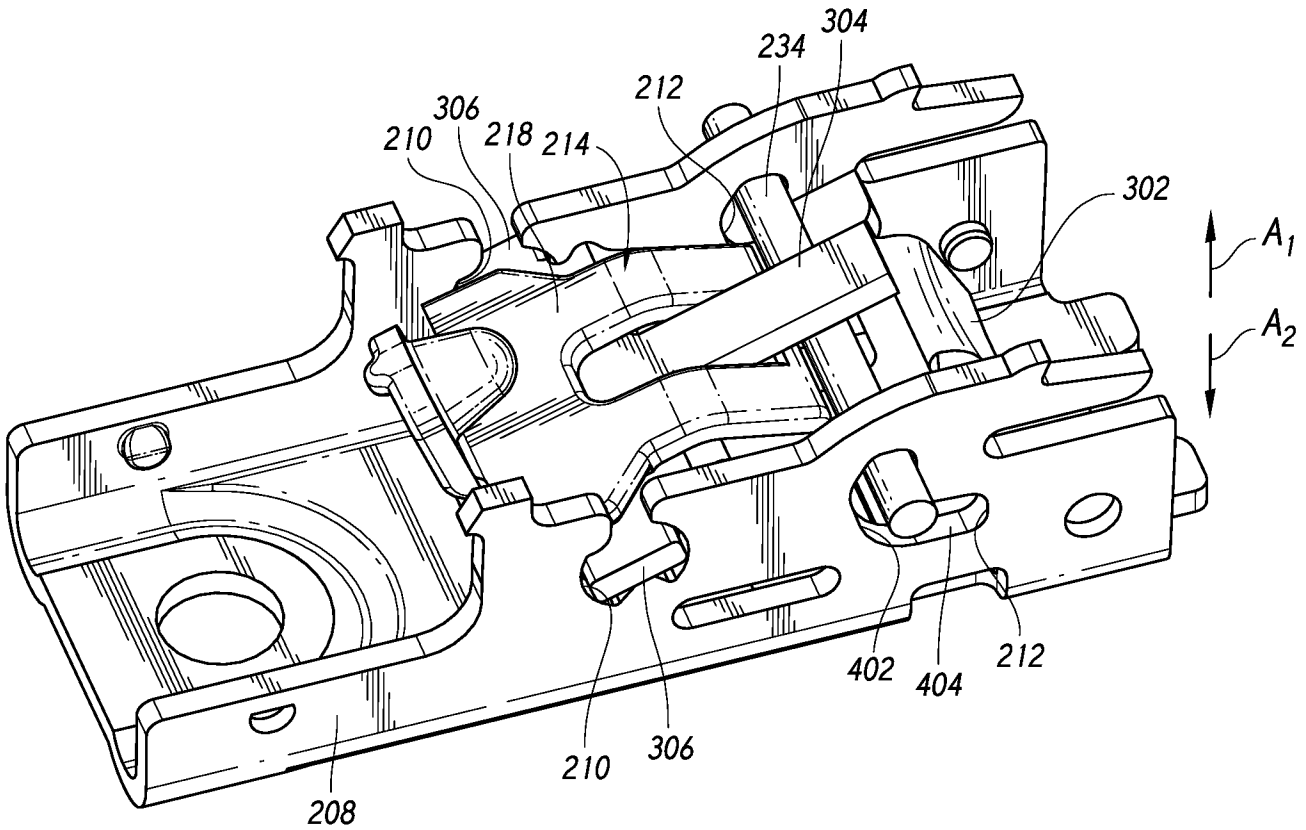
FIG. 4 is an enlarged isometric view of the several components of the buckle assembly configured in accordance with an embodiment of the present technology.

FIG. 4 is an enlarged isometric view of the frame 208, the pawl 214 and the locking pin 234 configured in accordance with an embodiment of the present technology. In the illustrated embodiment, the pawl 214 is rotatably coupled to the frame 208 via engagement of the tabs 306 with the first openings 210. The pawl 214 can rotate about the tabs 306 to move (e.g., rotate) the latch arm 302 in the directions of the arrows $A_1$ and $A_2$. The second openings 212 include upper or vertical portions 402 and lower or horizontal portions 404. Rotation of the pawl 214 about the tabs 306 moves the locking pin 234 in the directions of arrows $A_1$ and $A_2$ within the upper portions 402.

Figure 5A:
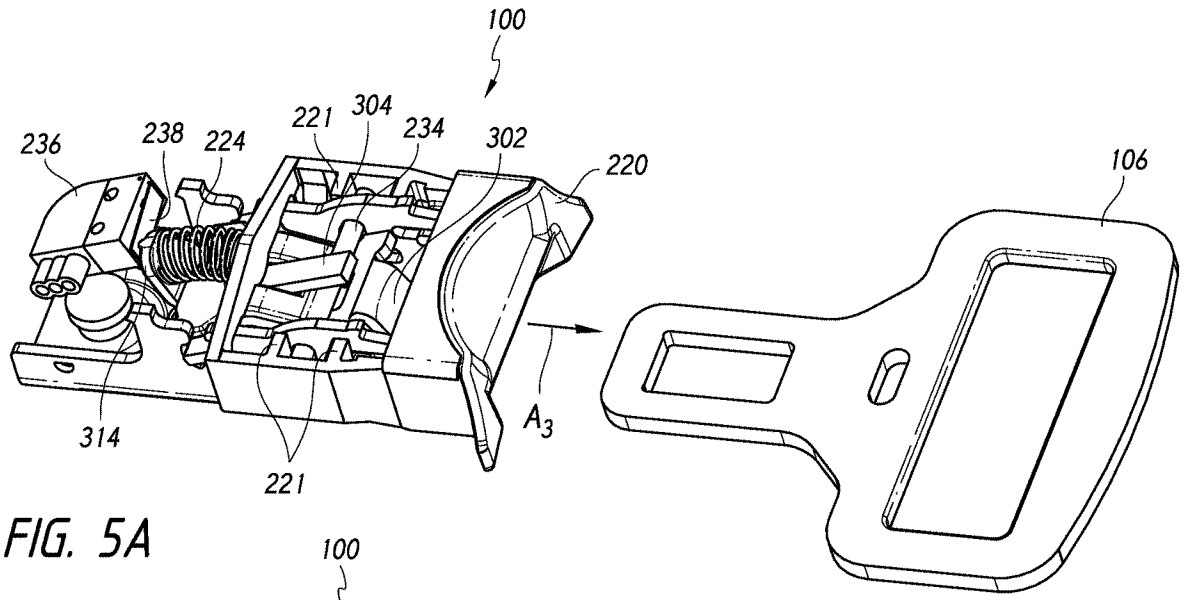
FIGS. 5A to 8C are isometric and side cross-sectional views of the connector and several components of the buckle assembly illustrating various stages of operation in accordance with an embodiment of the present technology.

FIGS. 5A to 8C are isometric and side cross-sectional views of the connector 106 and several components of the buckle assembly 100 illustrating various stages of operation in accordance with an embodiment of the present technology. For example, FIGS. 5A to 5C illustrate components of the buckle assembly 100 in an unlatched position, with the connector 106 spaced apart from the buckle assembly 100. Referring to FIGS. 5A to 5C together, in the unlatched position, the latch arm 302 is raised and the locking pin 234 is positioned in the upper portions 402 of the second openings 212. The first spring 224 is partially compressed, acting against the second spring mount 226 to urge the pawl 214 in a direction of rotation that drives the contact surface 316 on the drive portion 218 against the actuation lever 238 on the switch 236.

The contact between the contact surface 316 and the lever 238 provides an electrical indication via the switch 236 that the buckle assembly 100 is unlatched. For example, in some embodiments, the switch 236 can be part of an electrical circuit that is itself part of an electrical system in an associated vehicle. The electrical system can include buzzers, lights, or other components that can be energized depending on the condition of the electrical circuit that includes the switch 236. For example, in some embodiments, contact between the contact surface 316 and the lever 238 can open the switch 236. The associated electrical system can detect that the circuit is open and energize a buzzer and/or light to show that the buckle assembly 100 is unlatched. In other embodiments, engagement of the lever 238 can close the switch 236 to complete an electrical circuit that initiates the energization of a buzzer and/or light. Additionally, in several embodiments, a variety of electrical or mechanical interlocks can be initiated via operation of the switch 236. For example, in some embodiments, the electrical system of an associated vehicle can limit vehicle operation to a lower rate of speed based on the position of the switch 236 (i.e., open or closed)

When the buckle assembly 100 is in the unlatched position, the compression of the first spring 224 also acts on the first spring mount 222 to bias the release button 220 in the direction of arrow $A_3$, i.e., toward the opening 104 (FIG. 1). However, the release button 220 is maintained in a partially depressed position by the guide features 221 and the locking pin 234. Specifically, in the unlatched position, the locking pin 234 is positioned in the upper portions 402 of the second openings 212. The upper portions 402 prevent the locking pin 234 from moving in the direction of arrow $A_3$, and the locking pin 234 acts on the guide features 221 to similarly prevent movement of the release button 220 in the direction of arrow $A_3$. Additionally, in the unlatched position, the second spring 232 urges the ejector 230 toward the opening 104.

Figure 6A:
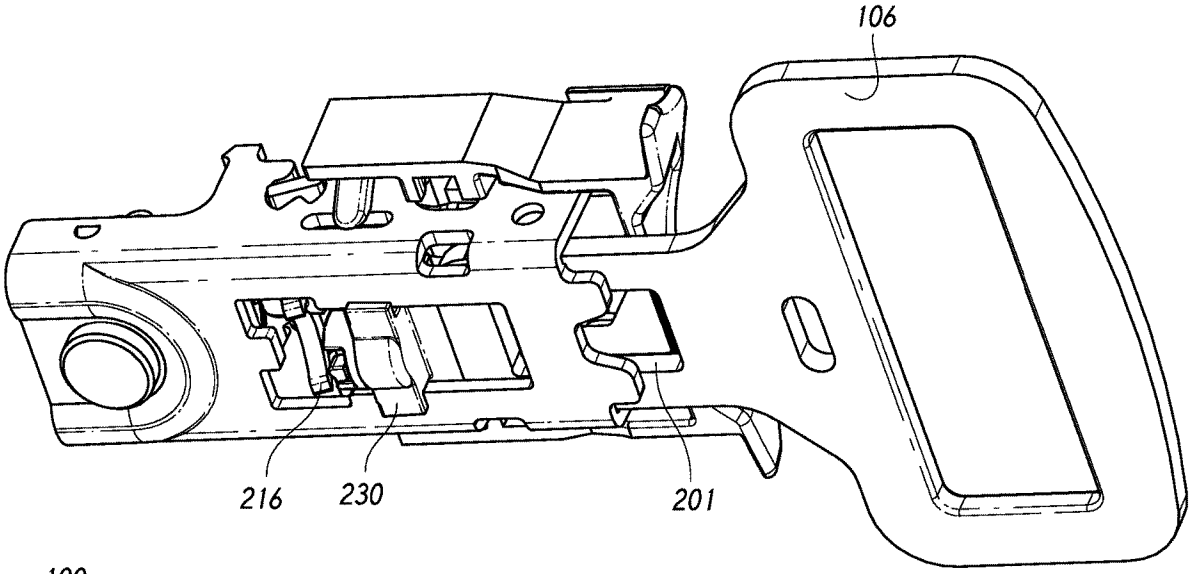
Figure 6B:
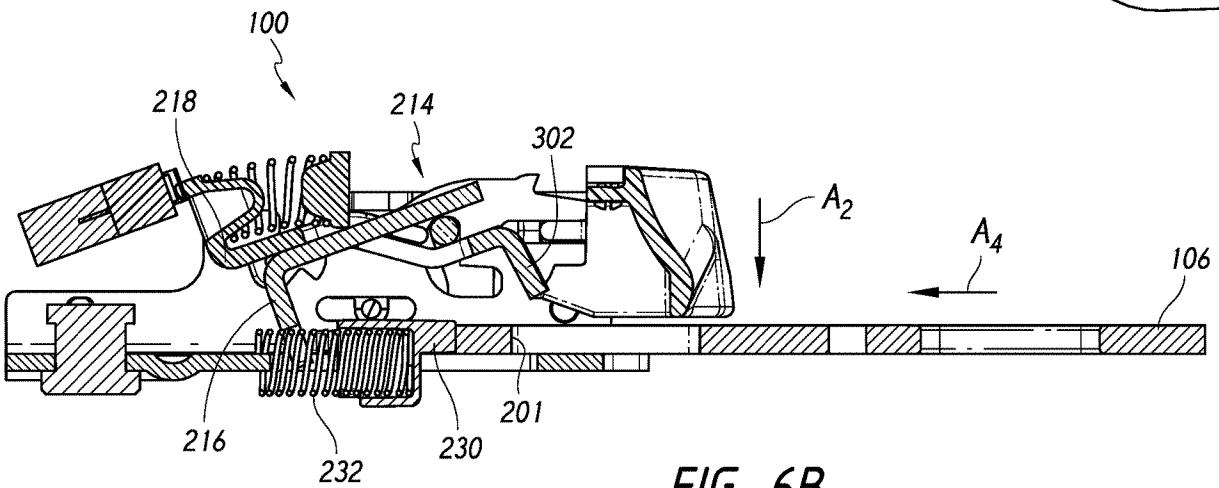

FIGS. 6A and 6B are isometric and side cross-sectional views, respectively, of the buckle assembly 100 in an unlatched position, with the connector 106 partially inserted into the opening 104. Insertion of the connector 106 in the direction of arrow $A_4$ drives the ejector 230 away from the opening 104 (FIG. 1), compressing the second spring 232. Continued insertion of the connector 106 drives the ejector 230 into contact with the latch portion 216 of the pawl 214, as shown in FIGS. 6A and 6B (second spring 232 not shown in FIG. 6A for clarity), and aligns the latch opening 201 with the latch arm 302. The contact between the ejector 230 and the latch portion 216 urges the pawl 214 to rotate and move the latch arm 302 in the direction of arrow $A_2$, toward the latch opening 201.

Figure 7A:
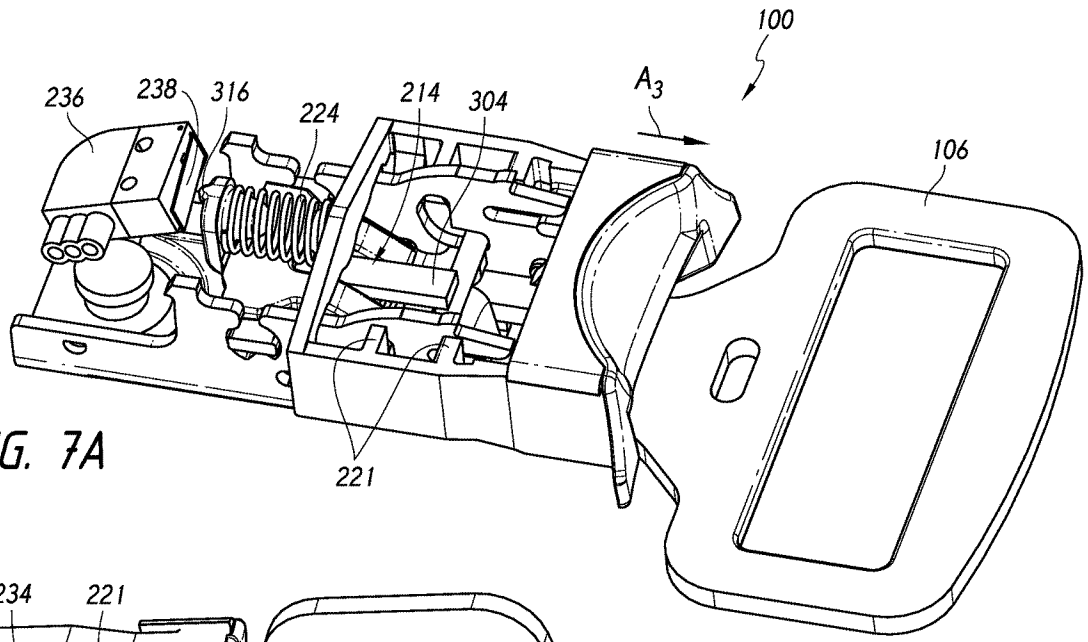
Figure 7B:
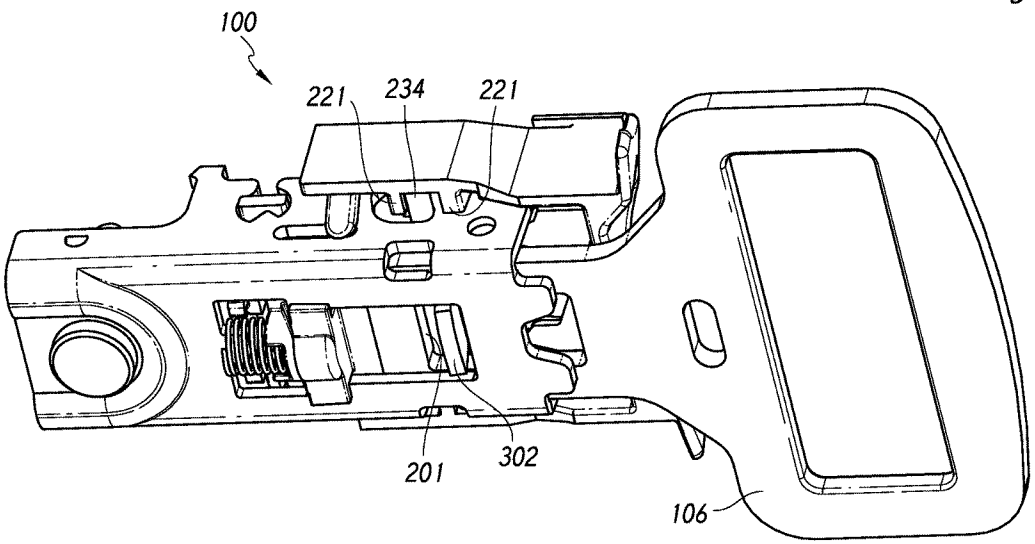
Figure 7C:
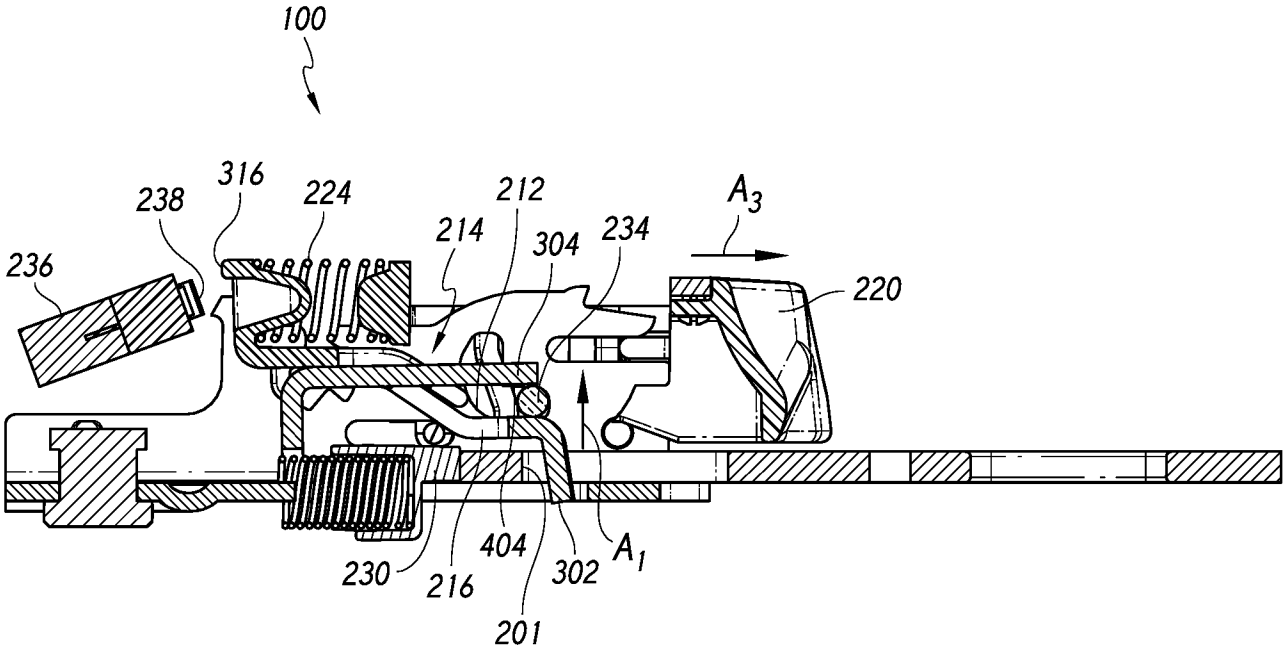

FIGS. 7A and 7B are isometric views, and FIG. 7C is a side cross-sectional view of the buckle assembly 100 in a latched position, with the connector 106 fully inserted into the opening 104. Comparing FIGS. 6A and 6B with FIGS. 7A to 7C, rotation of the pawl 214 in the direction of arrow $A_2$ drives the latch arm 302 fully into the latch opening 201, and the locking arm 304 drives the locking pin 234 to the lower portions 404 of the second openings 212. With the locking pin 234 in the lower portions 404 of the second openings 212, the upper portions 402 no longer prevent movement of the locking pin 234 and the release button 220 in the direction of arrow $A_3$. Accordingly, this enables the first spring 224 to drive the release button 220 in the direction of arrow $A_3$. Movement of the release button 220 in the direction of arrow $A_3$ drives the locking pin 234 in the direction of arrow $A_3$, via the guide features 221.

In the fully latched position shown in FIGS. 7A to 7C, the locking pin 234 prevents inadvertent unlatching of the buckle assembly 100. In particular, referring to FIG. 7C, the lower portions 404 of the second openings 212 prevent motion of the locking pin 234 in the direction of arrow $A_1$. The locking pin 234 acts on the latch portion 216 to prevent motion of the latch portion 216 in the direction of arrow $A_1$, and the latch arm 302 is thereby maintained in the latch opening 201. With the latch arm 302 extending into the latch opening 201, the connector 106 cannot be removed from the buckle assembly 100. Additionally, in the fully latched position, the contact surface 316 on the pawl 214 is spaced apart from the actuation lever 238 of the switch 236. This enables the switch 236 to provide an electrical indication that the buckle assembly 100 is latched, as described above.

Figure 8A:
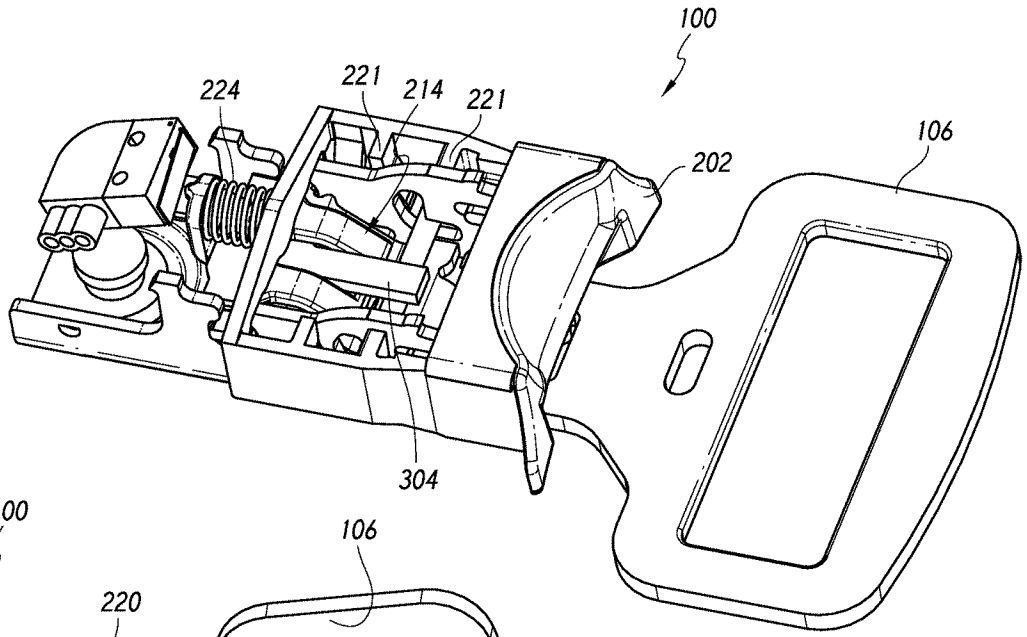
Figure 8B:
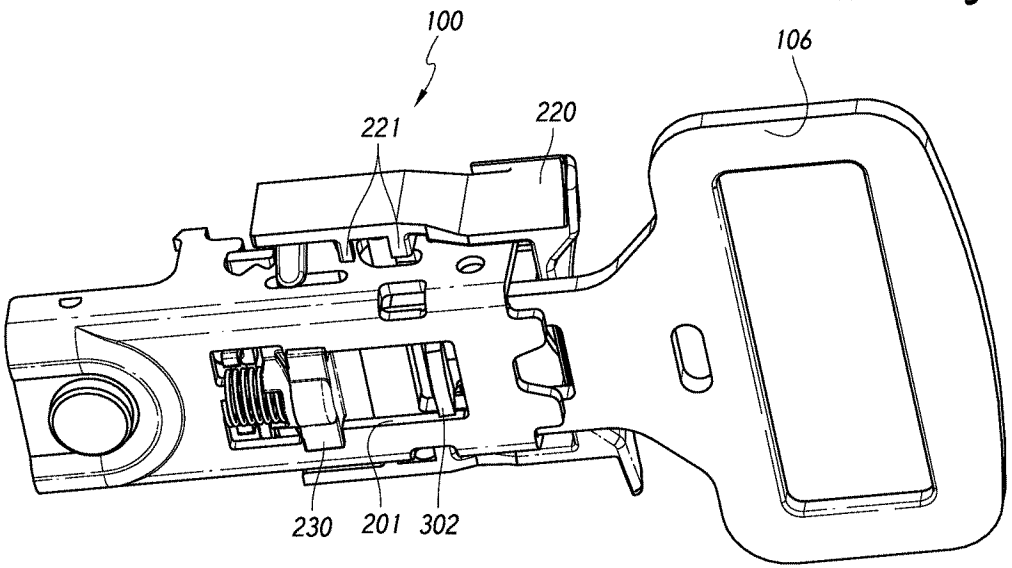
Figure 8C:
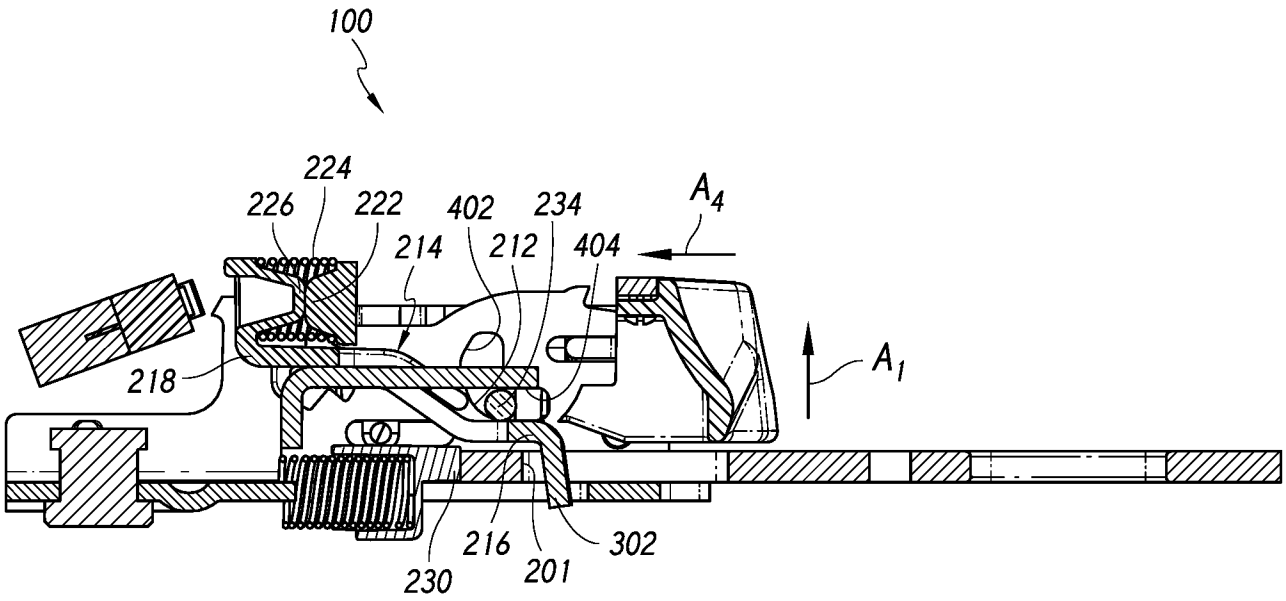

FIGS. 8A and 8B are isometric views, and FIG. 8C is a side cross-sectional view of the buckle assembly 100 in a latched position, with the connector 106 fully inserted in the opening 104. In the illustrated embodiment, the release button 220 is partially depressed to initiate unlatching of the buckle assembly 100. In particular, the release button 220 has been moved in the direction of arrow $A_4$, driving the locking pin 234 (via the guide features 221) toward the upper portions 402 of the second openings 212. Additionally, depression of the release button 220 has compressed the first spring 224. As the first spring 224 is being compressed, it exerts a first force against the drive portion 218, urging the pawl 214 to rotate and move the latch arm 302 in the direction of arrow $A_1$. In several embodiments, the first force is applied to the pawl 214 at an outer perimeter of the second spring mount 226. As the release button 220 is further depressed, the first spring mount 222 comes into direct contact with the second spring mount 226. The contact of the first spring mount 222 with the second spring mount 226 exerts a second force on the drive portion 218 that also urges the pawl 214 to rotate and move the latch arm 302 in the direction of arrow $A_1$.

In some embodiments, the second force can be greater than the first force. For example, in some embodiments, the first force is limited to a maximum value, from compression of the first spring, that occurs when the release actuator 220 is depressed to the position where the first spring mount 222 contacts the second spring mount 226. The second force, however, is not limited. That is, most (if not all) of the force exerted on the release actuator 220 (by, e.g., the user) in the direction of arrow $A_4$ is transmitted to the pawl 214 via the first force and the second force. Specifically, if the release actuator 220 is depressed to the position in which the first spring mount 222 contacts the second spring mount 226, any additional force applied to the release actuator 220 is transferred to the pawl 214 via the second force acting through the direct physical contact between the first spring mount 222 and the second spring mount 226. Regardless of whether the second force is greater than the first force, the second force provides additional force to rotate the pawl 214. In particular, the sum of the first force and the second force can result in a total force that can be significantly greater than the first force alone, and can help overcome any resistance to rotation of the pawl 214, as described in more detail below.

Figure 5B:
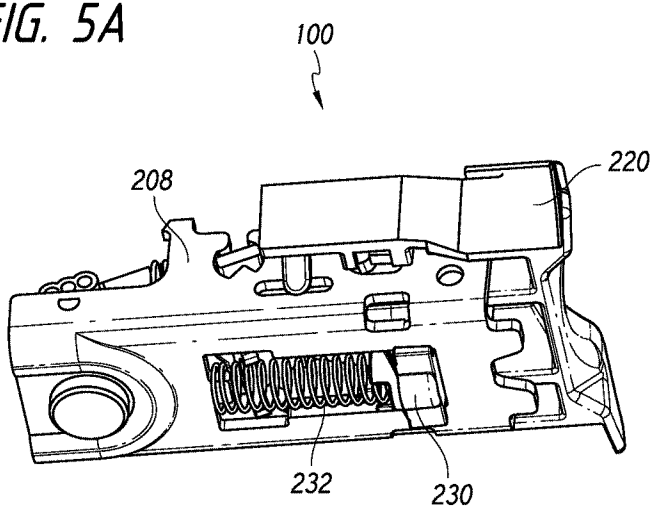
Figure 5B:
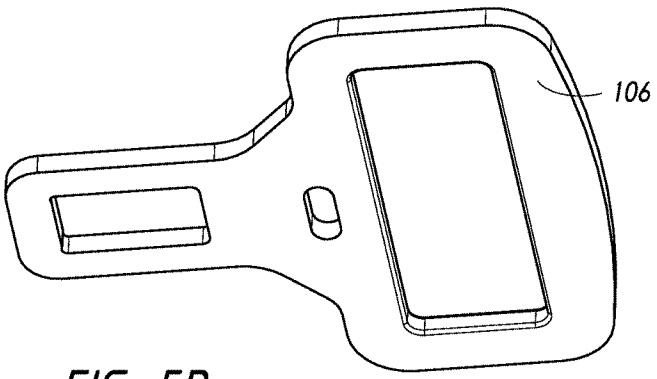
Figure 5C:
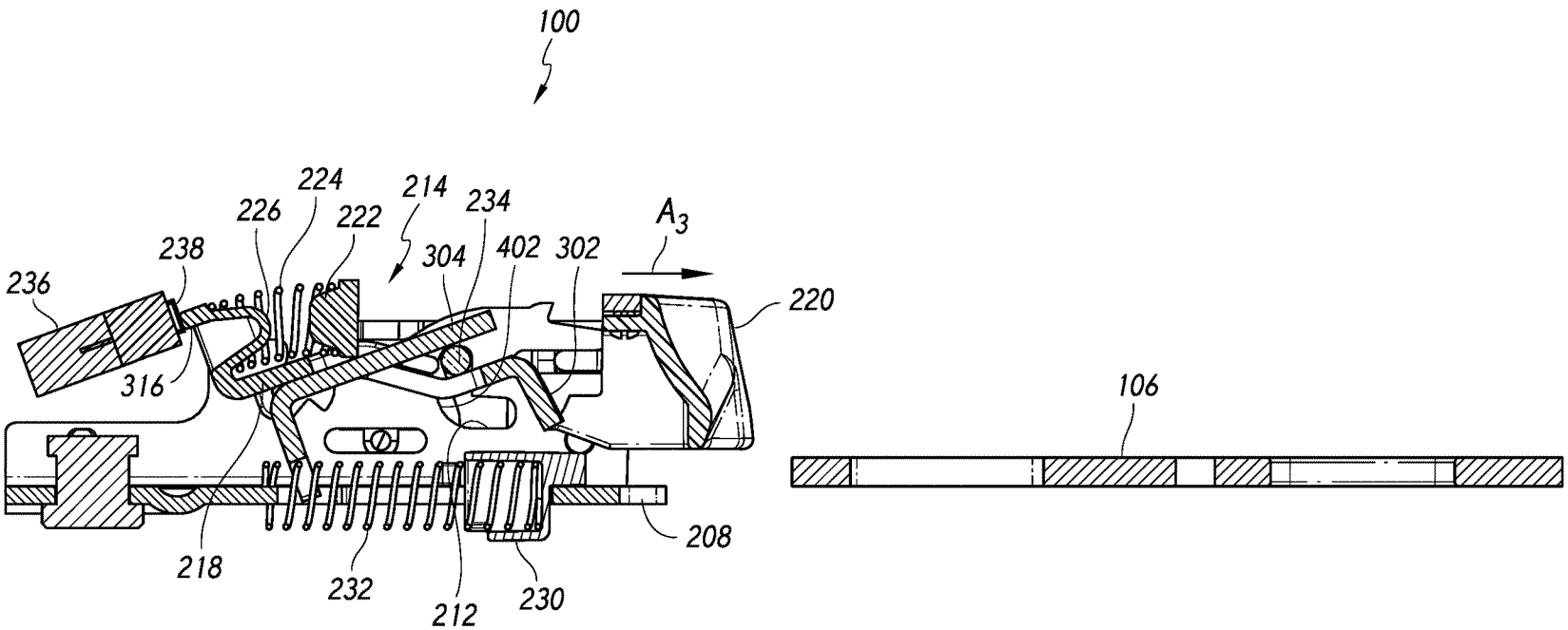

Depression of the release button 220 also drives the guide features 221 to move the locking pin 234. Specifically, the guide features 221 move the locking pin 234 to the junction of the lower portions 404 and the upper portions 402 of the second openings 212. With the locking pin 234 at the junction of the lower portions 404 and the upper portions 402, the first force and second force on the pawl 214 rotate the pawl, moving the latch arm 302 out of the latch opening 201 and moving the locking pin 234 in the direction of arrow $A_1$ within the upper portions 402 (as shown in FIGS. 5A to 5C). With the latch arm 302 withdrawn from the opening 201 in the connector 106, the second spring 232 urges the ejector 230 against the connector 106, ejecting the connector 106 from the buckle assembly 100 and returning the buckle assembly 100 to the unlatched condition shown in FIGS. 5A to 5C.

Contaminants (e.g., dirt, moisture, etc.) that enter a buckle assembly can increase the friction on a latch or otherwise restrict the free movement of the latch or other buckle assembly components. This increased friction can prevent the proper operation of the associated buckle assembly. For example, in many existing buckle assemblies, a spring or other compressible component is used to release a latch. To prevent spring damage, many buckle assemblies include release buttons that contact internal components of the associated buckle assembly and "bottom out" before they fully compress their associated springs. Accordingly, the maximum force that can be exerted with such buckle assemblies is limited to that which does not fully compress the spring. This spring force may be insufficient to overcome obstructions or contamination in many existing buckle assemblies.

Buckle assemblies configured in accordance with the present technology can provide for reliable operation in harsh environments. For example, in addition to exerting a first force on the pawl 214 via the first spring 224, the direct contact of the release button 220 with the pawl 214 provides a second force on the pawl 214. The second force is applied via direct physical contact, and is not limited to a force generated via spring pressure. As discussed above, the direct contact can provide for the transfer of all (or most) of the force exerted on the release button 220 to the pawl 214. The direct contact and the transfer of additional force provided by the embodiments disclosed herein can help to reduce the likelihood of obstructed or "jammed" buckle assemblies. Additionally, although the illustrated embodiments include direct physical contact between the release button 220 and the pawl 214 (via the first spring mount 220 and the second spring mount 226), other embodiments can provide for the transfer of all (or most) of the force exerted on the release button 220 to the pawl 214 via indirect contact. For example, one or more intermediate components (e.g., rods, levers, blocks, slides, spacers, or other components) can be positioned between the release button 220 and the pawl 214. The intermediate component(s) can thereby transfer the force from the release button 220 to the pawl 214.

In several of the embodiments described above, the direct contact between the release button 220 and the pawl 214 provides for a transfer of additional force to the pawl 214 to release the connector 106 from the buckle assembly 100. In other embodiments, the first biasing member 224 can be designed to provide for a direct transfer of additional force. For example, in some embodiments, the first biasing member 224 can be designed and positioned to fully compress and transfer all (or most) of the force exerted on the release button 220 to the pawl 214. Specifically, rather than direct contact between the release button 220 and the pawl 214, the first biasing member 224 can reach a fully compressed position (e.g., a solid height position) prior to contact between the release button 220 and the pawl 214. In such embodiments, the first biasing member 224 can effectively become a "solid" member (with adjacent coils of the biasing member in contact with one another) to transfer forces from the release button 220 to the pawl 214. In several such embodiments, the first biasing member 224 can be selected based on axial rigidity or other criteria. For example, the first biasing member 224 can be selected based on one or more factors that help reduce the likelihood of buckling or axial bending during complete compression.

Existing buckle assemblies often include switches that register their condition (e.g., latched or unlatched) based on the insertion of a connector. That is, the switches are positioned to be actuated by the insertion of a connector tongue into the buckle assembly and full engagement of the tongue with the buckle assembly. In general, insertion of a tongue corresponds with latching, and these existing switches can thereby provide an indication that the connector is fully engaged in most situations (e.g., by activation of a buzzer or other electrical component by the switch). However, when contaminants or other issues prevent a latch from moving into position, these existing buckle assemblies and switches can provide a false indication. That is, insertion of a tongue into these existing buckle assemblies can provide an indication that the buckle assembly is latched, even when contaminants have prevented the latch from moving into the latched position.

Buckle assemblies configured in accordance with the present technology can provide more reliable indications of their condition. In particular, the buckle assemblies disclosed herein include the switch 236 positioned to be actuated via movement of the pawl 214, and not merely by insertion of the connector 106. Specifically, referring to FIGS. 4 and 5A, actuation of the switch 236 requires rotation of the pawl 214 and corresponding movement of the latch arm 302 in the direction of arrow $A_2$. Accordingly, the buckle assemblies disclosed herein include condition indicating systems that provide enhanced reliability.

Moreover, the positioning of the switch 236 can provide for enhanced reliability of the buckle assembly 100 by reducing the exposure of the switch 236 to contaminants. For example, the buckle assembly 100 can be mounted in a vehicle with the lower portion 204 of the housing 102 positioned toward an associated seat, and the upper portion 202 of the housing 102 thereby being above the lower portion 204. In the illustrated embodiment of FIGS. 2 and 5A, the switch 236 is positioned within the upper portion 202, adjacent the actuation arm 314. With the upper portion 202 of the housing 102 being above the lower portion 204, contamination that enters the buckle assembly 100 will generally settle in the lower portion 204. Accordingly, the switch 236 will be exposed to less contaminants and will be less susceptible to interference or failure.

Figure 9:
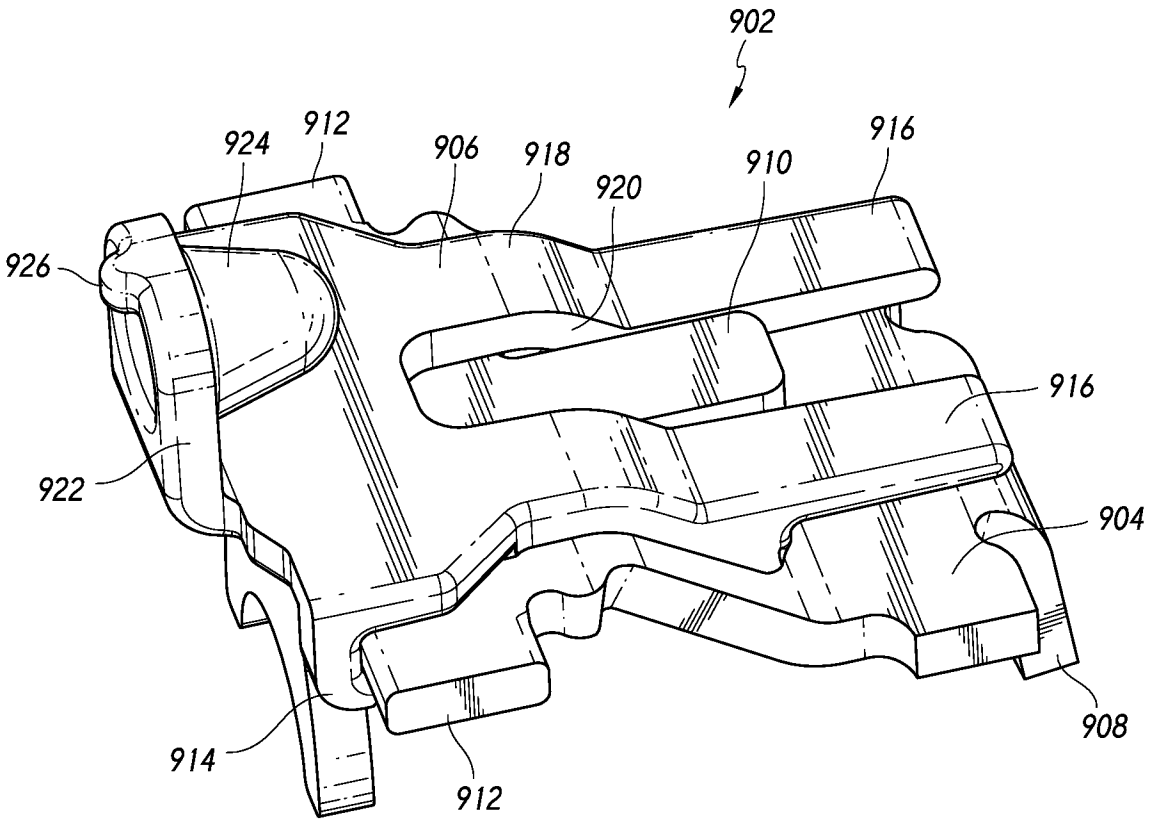
FIG. 9 is an enlarged isometric view of a pawl configured in accordance with another embodiment of the present technology.

FIG. 9 is an enlarged isometric view of a pawl 902 configured in accordance with an embodiment of the present technology. The pawl 902 includes several components that are at least generally similar to those of the pawl 214 that was described above with reference to FIG. 3. For example, in the illustrated embodiment, the pawl 902 includes a latch portion 904 and a drive portion 906. The latch portion 904 includes a latch arm 908, an engagement arm 910, and a pair of opposing tabs 912. The drive portion 906 includes a pair of hooks 914 (only one visible in FIG. 9), a pair of locking arms 916, and a curved body 918 having a slot 920. The drive portion 906 can be coupled to the latch portion 904 via extension of the engagement arm 910 through the slot 920, and engagement of the hooks 914 with the tabs 912. The drive portion 906 further includes an actuation arm 922 having a second spring mount 924 and a protrusion with a contact surface 926. Similar to the pawl 214, the contact surface 926 can engage the actuation lever 238 on the switch 236 (FIG. 2).

In several embodiments, the pawl 902 can be included in the buckle assembly 100 in place of the pawl 214. In such embodiments, several aspects of the operation of the buckle assembly 100 and the pawl 214 can be at least generally similar to that described above with respect to the buckle assembly 100 and the pawl 214. For example, with reference to FIGS. 4, 8A-C and 9, incorporation of the pawl 902 into the buckle assembly 100 can provide for unlatching of the buckle assembly 100 via depression of the release button 220. In particular, the release button 220 can compress the first spring 224 and exert a first force against the drive portion 906, urging the pawl 902 to rotate and move the latch arm 908 in the direction of arrow A1. Additionally, the first spring mount 222 can directly contact the second spring mount 924, exerting a second force on the drive portion 904 that also urges the pawl 902 to rotate and move the latch arm 908 in the direction of arrow A1.

Operation of the pawl 914 can also differ in several aspects from that of operation of the pawl 214. As discussed above with respect to operation of the pawl 214, the locking arm 304 of the latch portion 216 can move the locking pin 234. In contrast, with reference to FIGS. 4, 8A-C and 9, incorporation of the pawl 902 into the buckle assembly 100 can include movement of the locking pin 234 via the drive portion 906. In particular, rotation of the pawl 902 in the direction of arrow $A_2$ drives the locking arms 916 of the drive portion 906 against locking pin 234, moving the locking pin 234 to the lower portions 404 of the second openings 212.

Buckle assemblies and restraint system components configured in accordance with the present technology can be designed and constructed to conform to a variety of regulations and standards. For example, the buckle assemblies and restraint system components disclosed herein can conform with Standard No. 209 (49 C.F.R. §571.209), SAE Standard J386 (Society of Automotive Engineers, Standard J386), UNECE Regulation No. 16 (United Nations Economic Commission for Europe, Technical Prescriptions for Wheeled Vehicles, Addendum 15, Regulation No. 16), and/or other regulations and standards.

From the foregoing, it will be appreciated that specific embodiments have been described herein for purposes of illustration, but that various modifications may be made without deviating from the spirit and scope of the present technology. Those skilled in the art will recognize that numerous modifications or alterations can be made to the components or systems disclosed herein. Moreover, certain aspects of the present technology described in the context of particular embodiments may be combined or eliminated in other embodiments. Further, while advantages associated with certain embodiments have been described in the context of those embodiments, other embodiments may also exhibit such advantages, and not all embodiments need necessarily exhibit such advantages to fall within the scope of the present technology. Accordingly, the inventions are not limited except as by the appended claims.

I claim:

1. A buckle assembly for releasably engaging a web connector, the buckle assembly comprising:

a frame having a pair of opposing openings;

a pawl pivotally mounted to the frame via the opposing openings, wherein the pawl includes a latch portion positioned to releasably engage the web connector;

a release actuator operably mounted to the frame; and a biasing member operably positioned between the release actuator and the pawl, wherein the release actuator is configured to move to a first position to compress the biasing member against the pawl to urge the pawl to rotate and disengage the latch portion from the web connector, and wherein the release actuator is further configured to move to a second position to further compress the biasing member and to contact the pawl to further urge the pawl to rotate and disengage the latch portion from the web connector.

2. The buckle assembly of claim 1, further comprising an ejector slidably coupled to the frame, wherein the ejector is movable via the web connector to urge the pawl to rotate and engage the latch portion with the web connector.

3. The buckle assembly of claim 1 wherein the pawl rotates in a first direction to disengage the latch portion, wherein the buckle assembly further comprises an ejector slidably coupled to the frame and positioned to be engaged by a tongue of the web connector, wherein insertion of the tongue into the buckle assembly drives the ejector against the pawl to rotate the pawl in a second direction that engages the latch portion with the tongue.

4. The buckle assembly of claim 1 wherein the latch portion includes a locking arm, wherein the pawl further includes a drive portion, and wherein the drive portion includes:

a curved body having a slot, wherein the arm extends through the slot;

a hook shaped to engage the latch portion; and a biasing member mount extending from the body, wherein the biasing member is positioned between the release actuator and the biasing member mount.

5. The buckle assembly of claim 1 wherein the pawl includes a first biasing member mount, wherein the release actuator includes a second biasing member mount, wherein the biasing member extends between the first biasing member mount and the second biasing member mount, and wherein the release actuator urges the pawl to rotate via direct physical contact between the first biasing member mount and the second biasing member mount.

6. The buckle assembly of claim 1, further comprising a switch configured to provide an indication of engagement of the web connector by the buckle assembly, wherein rotation of the pawl to disengage the latch portion from the web connector includes rotation of the pawl to contact the switch.

7. The buckle assembly of claim 6 wherein the pawl further includes a drive portion, wherein the drive portion is coupled to the latch portion, wherein the biasing member is operably positioned between the drive portion and the release actuator, and wherein rotation of the pawl to contact the switch includes contact between the drive portion and the switch.

8. The buckle assembly of claim 7 wherein the biasing member is a first biasing member, wherein the buckle assembly further comprises a second biasing member, and wherein the second biasing member biases the ejector to move the web connector out of the buckle assembly.

9. A personal restraint system, comprising:

a web connector;

a buckle assembly for releasably engaging the web connector, the buckle assembly including a frame;

a pawl rotatably coupled to the frame, wherein the pawl includes a latch portion configured to engage the web connector;

a release actuator movably coupled to the frame; and a biasing member operably coupled between the release actuator and the pawl, wherein the release actuator is configured to move to a first position to exert a first force on the pawl via the biasing member, wherein the release actuator is further configured to move to a second position to bring the release actuator into contact with the pawl and exert a second force on the pawl, and wherein the first force and the second force together urge the pawl to rotate in a direction that disengages the latch portion from the web connector.

10. The personal restraint system of claim 9 wherein the biasing member is a first biasing member, and wherein the buckle assembly further includes:

an ejector slidably coupled to the frame; and a second biasing member positioned to bias the ejector in a direction that moves the web connector out of the buckle assembly, wherein insertion of the web connector into the buckle assembly moves the elector to compress the second biasing member, wherein the direction is a first direction, and wherein the ejector is movable to contact the pawl and exert a third force on the pawl to rotate the pawl in a second direction, opposite to the first direction, that engages the latch portion with the web connector.

11. The personal restraint system of claim 9 wherein the pawl further includes a drive portion coupled to the latch portion, and wherein the first force and the second force are applied to the pawl via the drive portion.

12. The personal restraint system of claim 11 wherein the drive portion includes a slot and the latch portion includes a locking arm, and wherein the drive portion is secured to the latch portion via extension of the locking arm through the slot.

13. The personal restraint system of claim 9 wherein the pawl further includes a drive portion having a biasing member mount, wherein the first force is applied via contact between the biasing member and the drive portion at an outer perimeter of the biasing member mount, and wherein the second force is applied via contact between the release actuator and the biasing member mount.

14. The personal restraint system of claim 9 wherein the buckle assembly further includes a switch, wherein the pawl further includes a drive portion coupled to the latch portion, and wherein the switch is positioned to be actuated via the drive portion.

15. The personal restraint system of claim 14 wherein the buckle assembly further includes a housing having an upper portion and a lower portion, wherein the web connector is received in the lower portion, and wherein the switch is positioned within the upper portion.

16. A buckle assembly, comprising:

a frame;

a pawl having a latch portion, wherein the pawl is movably coupled to the frame and operable to releasably engage the latch portion with a web connector;

a release button slidably coupled to the frame; and a biasing member operably coupled between the release button and the pawl, wherein the biasing member is configured to exert a force against the pawl to rotate the pawl in a direction that disengages the latch portion from the web connector, and wherein the release button is configured to compress the biasing member to a solid height position to increase the force on the pawl.

17. The buckle assembly of claim 16 wherein the biasing member is a coil spring having a plurality of coils, and wherein the solid height position includes compression to bring individual coils into contact with adjacent coils.

18. The buckle assembly of claim 16 wherein the pawl further includes a drive portion coupled to the latch portion, and wherein the buckle assembly further comprises a switch operable to provide an indication of a condition of the buckle assembly, wherein rotation of the pawl to disengage the latch portion from the web connector includes the drive portion contacting the switch.

19. The buckle assembly of claim 18, further comprising a housing having an upper portion and a lower portion, wherein the latch portion releasably engages the web connector within a space that is at least partially enclosed by the lower portion, and wherein the switch is positioned within a space that is at least partially enclosed by the upper portion.

20. The buckle assembly of claim 16 wherein the direction is a first direction, the buckle assembly further comprising an ejector slidably coupled to the frame, wherein the ejector is movable via the connector to engage the pawl and rotate the pawl in a second direction that engages the latch portion with the web connector.

* * * * *